US009003677B2

(12) United States Patent
Goodsmith et al.

(10) Patent No.: US 9,003,677 B2
(45) Date of Patent: Apr. 14, 2015

(54) SYSTEM AND METHOD FOR TONING FOOTWEAR

(75) Inventors: Tracy Goodsmith, Denver, CO (US); Steven McIlroy, Fort Collins, CO (US); Dale R. Bathum, Boulder, CO (US); Christine L. Saito, Boulder, CO (US); Katherine Santos, Lyons, CO (US); Kelsey Zoellner, Denver, CO (US)

(73) Assignee: Crocs, Inc., Niwot, CO (US)

( * ) Notice: Subject to any disclaimer, the term of this patent is extended or adjusted under 35 U.S.C. 154(b) by 880 days.

(21) Appl. No.: 13/090,917

(22) Filed: Apr. 20, 2011

(65) Prior Publication Data

US 2012/0096744 A1 Apr. 26, 2012

Related U.S. Application Data

(60) Provisional application No. 61/326,157, filed on Apr. 20, 2010, provisional application No. 61/415,299, filed on Nov. 18, 2010.

(51) Int. Cl.

| | |
|---|---|
| ***A43B 13/14*** | (2006.01) |
| ***A43B 13/12*** | (2006.01) |
| ***A43B 3/10*** | (2006.01) |

(52) U.S. Cl.

CPC ..... *A43B 13/122* (2013.01); *A43B 3/108* (2013.01); *A43B 13/145* (2013.01)

(58) Field of Classification Search

CPC ..... A43B 13/00; A43B 13/14; A43B 13/141; A43B 13/143; A43B 13/145; A43B 13/146; A43B 13/148; A43B 3/0036; A43B 3/0042

USPC ..... 36/25 R, 31, 103, 107

See application file for complete search history.

(56) References Cited

U.S. PATENT DOCUMENTS

| | | | | |
|---|---|---|---|---|
| 3,936,956 | A | 2/1976 | Famolare, Jr. | |
| 4,030,213 | A * | 6/1977 | Daswick | 36/30 R |
| 4,041,618 | A | 8/1977 | Famolare, Jr. | |
| 4,041,619 | A * | 8/1977 | Sapper | 36/25 R |
| 4,266,349 | A | 5/1981 | Schmohl | |

(Continued)

FOREIGN PATENT DOCUMENTS

| | | |
|---|---|---|
| EP | 2156762 A1 | 2/2010 |
| WO | 97036508 A1 | 10/1997 |

(Continued)

OTHER PUBLICATIONS

International Search Report and Written Opinion issued in PCT/US2011/033274 mailed Jul. 15, 2011, 15 pages.

*Primary Examiner* — Marie Bays

(74) *Attorney, Agent, or Firm* — Faegre Baker Daniels LLP

(57) ABSTRACT

Systems and methods for toning footwear include a combination of a support ring, an insole with a cushioning material configured to contact a user's foot, and an outsole with one or more convex regions to create instability in the footwear. The support ring or stiffener band can be coupled to the outsole between the insole on one side and the forefoot and heel toning convexities on the other side. In some embodiments, the stiffener band can be formed of a material different from and stiffer than the material of the outsole. In accordance with various embodiments, when a user wears the toning footwear while walking, an increase in both the toning and strengthening of the calves, hamstrings and/or glutes results.

24 Claims, 34 Drawing Sheets

(56) References Cited

U.S. PATENT DOCUMENTS

| | | | | |
|---|---|---|---|---|
| RE31,173 | E * | 3/1983 | Daswick | 36/30 R |
| 4,897,936 | A | 2/1990 | Fuerst | |
| 4,951,938 | A | 8/1990 | Smith, IV | |
| 5,131,173 | A * | 7/1992 | Anderie | 36/25 R |
| 6,131,315 | A | 10/2000 | Frye | |
| 7,007,411 | B2 | 3/2006 | Davis | |
| 7,357,766 | B2 | 4/2008 | Langer | |
| 7,685,740 | B2 * | 3/2010 | Sokolowski | 36/8.3 |
| 8,266,825 | B2 * | 9/2012 | Pfister | 36/30 R |
| 8,307,569 | B2 * | 11/2012 | McInnis et al. | 36/28 |
| 8,424,221 | B2 * | 4/2013 | Litchfield et al. | 36/28 |
| 2005/0086838 | A1 | 4/2005 | Khantzis | |
| 2007/0107264 | A1 * | 5/2007 | Meschter et al. | 36/76 R |
| 2010/0107448 | A1 * | 5/2010 | Fallow et al. | 36/103 |
| 2010/0251565 | A1 * | 10/2010 | Litchfield et al. | 36/28 |
| 2011/0126422 | A1 * | 6/2011 | Vattes et al. | 36/10 |

FOREIGN PATENT DOCUMENTS

| | | | |
|---|---|---|---|
| WO | 2008102189 | A1 | 8/2008 |
| WO | 2009104029 | A1 | 8/2009 |
| WO | 2009121388 | A1 | 10/2009 |
| WO | 2010020391 | A1 | 2/2010 |
| WO | W02010022532 | A2 | 3/2010 |

* cited by examiner

900

SYSTEM AND METHOD FOR TONING FOOTWEAR

CROSS-REFERENCE TO RELATED APPLICATIONS

This application claims the benefit of U.S. Provisional Patent Application Ser. No. 61/326,157, filed on Apr. 20, 2010, and U.S. Provisional Patent Application Ser. No. 61/415,299, filed on Nov. 18, 2010, both of which are incorporated herein by reference in their entireties for all purposes.

TECHNICAL FIELD

Various embodiments of the present invention generally relate to footwear. More specifically, embodiments of the present invention relate to toning footwear.

BACKGROUND

Various muscles are activated during walking and/or running with the use of traditional footwear. For example, muscles in the lower body of an individual can be activated in response to the repetitive impact forces generated in a gait cycle of the individual wearing traditional footwear. A walker's foot, for example, can experience these impact forces at various points during a typical gait cycle. The gait cycle associated with traditional footwear may begin with the heel strike phase, where the initial ground contact at the lateral side of the heel takes place. The heel strike phase lasts until the rest of the foot or shoe contacts the ground, known as the flat foot phase. In the flat foot phase, the individual's weight rolls forward and inward onto the forefoot as the arch collapses, and moves onto the inner and front part of the forefoot where the foot is pushed off the ground and propelled forward. The flat foot phase lasts until the individual's heel lifts, thereby beginning the toe off phase.

SUMMARY

Systems and methods are described for toning footwear. In some embodiments, a shoe for strengthening and/or toning muscles includes an outsole and a support band. The outsole may be formed of a first material and the support band may be formed from a second material. The outsole has an outer perimeter, a forefoot portion, a heel portion, and a midfoot portion located between the forefoot portion and heel portion. In some embodiments, the forefoot portion, the heel portion, and the midfoot portion are formed integrally of a resin molded foam material. The forefoot portion and the heel portion can include concentric rings and/or contour ridges.

In some embodiments, when the outsole is set on a flat ground surface, the outsole contacts the flat ground surface at a forefoot contact area of the forefoot portion and at a heel contact area of the heel portion. A first distance, measured perpendicularly to the flat ground surface, separates the flat ground surface and the forefoot portion. The magnitude of the first distance may increase from the forefoot contact area toward the outer perimeter of the shoe, e.g., along both directions of a line spanning the forefoot portion and intersecting the forefoot contact area. In some embodiments the line may be in a first transverse plane intersecting the forefoot contact area. Both the line and the first transverse plane may be figurative. A second distance, measured perpendicularly to the flat ground surface, separates the flat ground surface and the heel portion. The magnitude of the second distance may increase from the heel contact area toward the outer perimeter of the shoe, e.g., along both directions of a line spanning the heel portion and intersecting the heel contact area. In some embodiments the line may be in a second transverse plane spanning the heel portion and intersecting the heel contact area. Both the line and the second transverse plane may be figurative.

Along a longitudinal plane intersecting the forefoot contact area and the heel contact area and orthogonal to both the first and second transverse planes, a third distance, measured perpendicularly to the flat ground surface, between the flat ground surface and the outsole decreases from a front end of the outer perimeter toward the forefoot contact area, increases from the forefoot contact area toward the midfoot portion, decreases from the midfoot portion toward the heel contact area, and increases from the heel contact area toward a back end of the outer perimeter. In some embodiments, the outsole includes contour ridges and/or concentric ridges and the first, second, third distances are measured from the lowest portion of the ridges. The longitudinal plane may be figurative.

The support band can be coupled to the outsole in various embodiments of the present invention. In some embodiments, the support band is formed of a second material different from, and stiffer than, the first material. The support band can surround, at least partially, one or more of the heel portion, the forefoot portion, and the midfoot portion. In various embodiments, the support band is a continuous and closed band surrounding the outsole along the outer perimeter. In some embodiments, the support band can extend continuously along an entirety of the outer perimeter. The support band, in one or more embodiments, can be positioned further from the flat ground surface than any portion of the forefoot portion and the heel portion. In various embodiments, the support band includes a contour ridge.

In some embodiments, the first material comprises ethylene-vinyl acetate and the second material comprises thermoplastic polyurethane. In one or more embodiments, the first material consists of ethylene-vinyl acetate and the second material consists of thermoplastic polyurethane.

In various embodiments, the support band is wider in a first location adjacent to the midfoot portion than in a second location adjacent to the front end of the outer perimeter and is wider in the first location than in a third location adjacent to the back end of the outer perimeter.

Some embodiments provide for toning footwear with an insole, an outsole, and a stiffener band. According to one or more embodiments, the insole can be configured to contact a user's foot. The outsole can be formed of a first material with a forefoot toning convexity and a heel toning convexity. The stiffener band can be coupled to the outsole between the insole on one side and the forefoot and heel toning convexities on another side. In some embodiments, the stiffener band can be formed of a second material different from and stiffer than the first material, the stiffener band at least partially surrounding one or both of the forefoot toning convexity and the heel toning convexity.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the scope of the present invention. Accordingly, the drawings and detailed description are to be regarded as illustrative in nature and not restrictive.

BRIEF DESCRIPTION OF THE DRAWINGS

Embodiments of the present invention will be described and explained through the use of the accompanying drawings in which.

Figure 1:
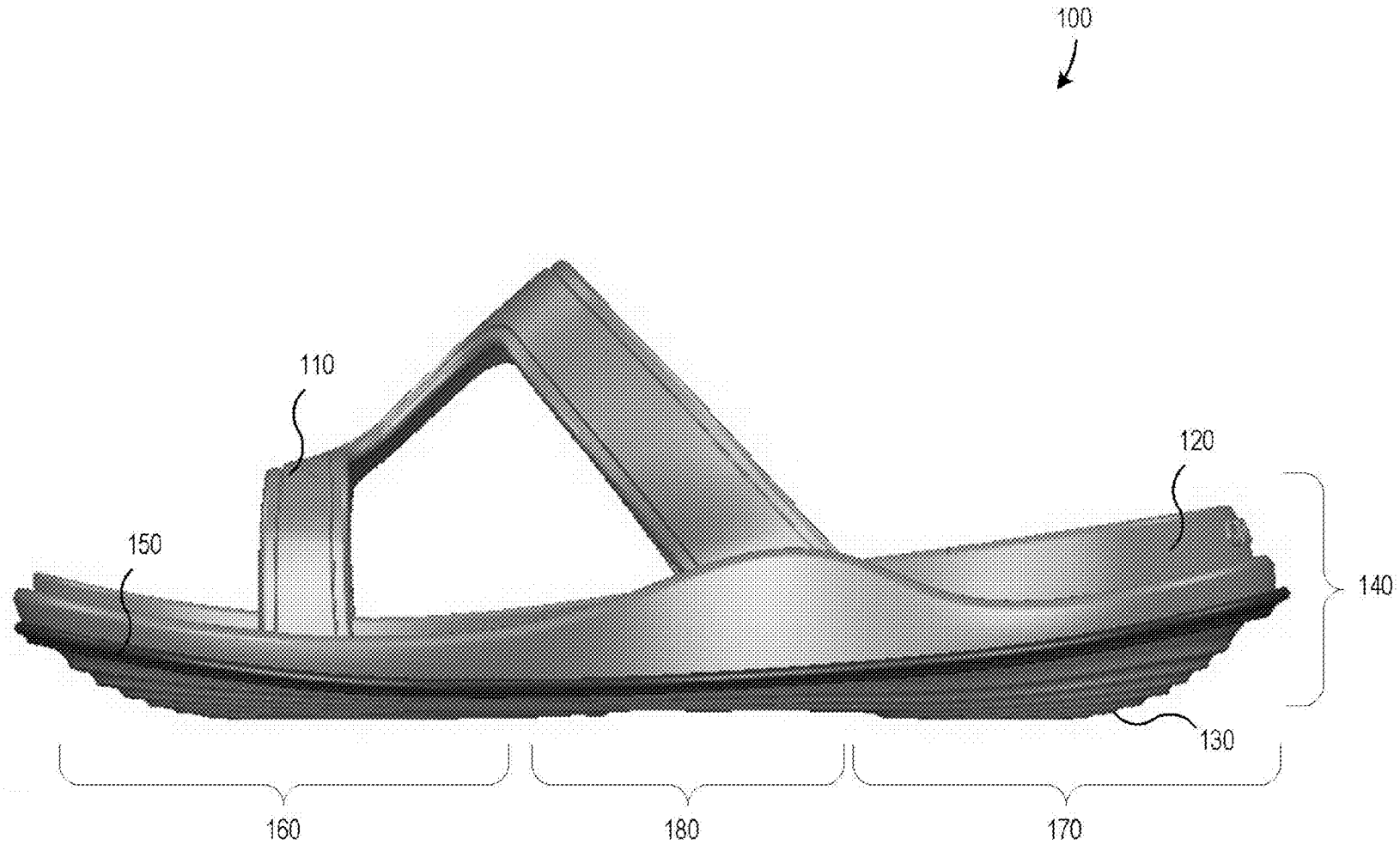
FIG. 1 is an inner side view of a toning sandal in accordance with some embodiments of the invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims and of the present disclosure.

DETAILED DESCRIPTION

Various embodiments of the present invention generally relate to footwear. More specifically, embodiments of the present invention relate to toning footwear. Among other things, some embodiments of the present invention provide for various toning footwear pieces, and methods for manufacturing such pieces. In various cases, the footwear pieces are molded from a lofted material.

In accordance with various embodiments of the present invention, when a user wears the toning footwear while walking, an increase in both the toning and strengthening of the calves, hamstrings and/or glutes may result. The toning footwear system of some embodiments includes a combination of a plate (or band or ring), a cushioning (footbed) material, and an outsole. The plate can be a thermoplastic urethane or thermoplastic polyurethane (TPU) plate that is designed to moderate movement in the wearer (more or less flexibility) while walking. The moderation of the movement in the wearer initiates a spectrum of muscle activity (e.g. "less to more"). The cushioning material may be Croslite® in some embodiments, which is manufactured by Crocs, Inc. of Niwot, Colo. The cushioning material can be moderated for firmer or softer cushioning in order to initiate a spectrum of muscle activity (e.g. "less to more"). In some embodiments, the outsole is a footmapped outsole designed to produce a variety of walking rhythms in order to initiate a spectrum of muscle activity (e.g. "less to more").

In some embodiments, the toning footwear system includes an upper/outsole mold, a separate cemented footbed, and a TPU ring. In some embodiments, the toning footwear includes a shoe sole for toning with an insole, an outsole, and a stiffener band. The insole is typically configured to contact a user's foot. The outsole can be formed of a first material in such a way that the outsole has a forefoot toning convexity and a heel toning convexity. In some embodiments, the stiffener band is coupled to (or integrally formed with) the outsole. The stiffener band can be located, in some embodiments, between the insole on one side and the forefoot and heel toning convexities on another side. The stiffener band can be formed from a second material different from, and stiffer than, the first material from which the outsole is formed. In one or more embodiments, the stiffener band can be at least partially surrounding one or both of the forefoot toning convexity and the heel toning convexity.

In the following description, for the purposes of explanation, numerous specific details are set forth in order to provide a thorough understanding of embodiments of the present invention. It will be apparent, however, to one skilled in the art that embodiments of the present invention may be practiced without some of these specific details.

The phrases "in some embodiments," "according to some embodiments," "in the embodiments shown," "in other embodiments," and the like generally mean the particular feature, structure, or characteristic following the phrase is included in at least one embodiment of the present invention, and may be included in more than one embodiment of the present invention. In addition, such phrases do not necessarily refer to the same embodiments or different embodiments.

FIG. 1 is an inner side view of a toning sandal 100 in accordance with some embodiments of the invention. As illustrated in FIG. 1, toning sandal 100 includes an upper 110 and a sole 140. The sole 140 includes a footbed (or insole) 120, outsole 130, and support band 150. Support band 150 may also be referred as a support ring or a stiffener band or a plate. The upper 110 is shaped and sized to receive and secure the wearer's foot (not shown). The upper 110, in various embodiments of the present invention, can include various straps or vamp sections in different designs (e.g., sandals, flip-flops, clogs, and the like) to secure the wearer's foot. The footbed (or insole) 120 is configured to contact the wearer's foot and may include various cushioning and support components and/or designs.

In some embodiments, outsole 130 is made from ethylene-vinyl acetate and support band 150 is made from thermoplastic polyurethane. Based on the disclosure provided herein, one of ordinary skill in the art will appreciate that the outsole 130 and/or support band 150 may be constructed with other suitable materials that provide the desired characteristics.

Support band 150 may surround all or a portion of the perimeter of the sole 140. For example, support band 150 may be a continuous and closed band. As another example, support band 150 may be two open rings configured to be positioned around the heel portion and forefoot portion of the footwear. In some embodiments, support band 150 may be configured to be secured to the footwear via a snap fit. In other embodiments, support band 150 may be integrally formed with the footwear or secured via an adhesive. In accordance with some embodiments, support band 150 can add a structural rigidity or stiffness to the footwear. As a result, the shoe will bend easier when the band is not present. In some embodiments, support band 150 can have a uniform or varying width and may include one or more ridges.

As will be described in more detail below, the outsole 130 can include one or more portions with one or more toning convexity regions to increase the toning and/or strengthening of the calves, hamstrings and/or glutes from the gait cycle of a wearer. The convexity regions are configured to create an instability that requires the wearer to activate the calves, hamstrings and/or glutes to a greater degree when compared to traditional footwear. As illustrated in FIG. 1, the outsole includes a forefoot portion 160, a heel portion 170, and a midfoot portion 180 each shaped in such a way as to increase toning and/or strengthening of some muscles. In some embodiments, forefoot portion 160, heel portion 170, and midfoot portion 180 are formed integrally of a resin molded foam material.

Figure 2:
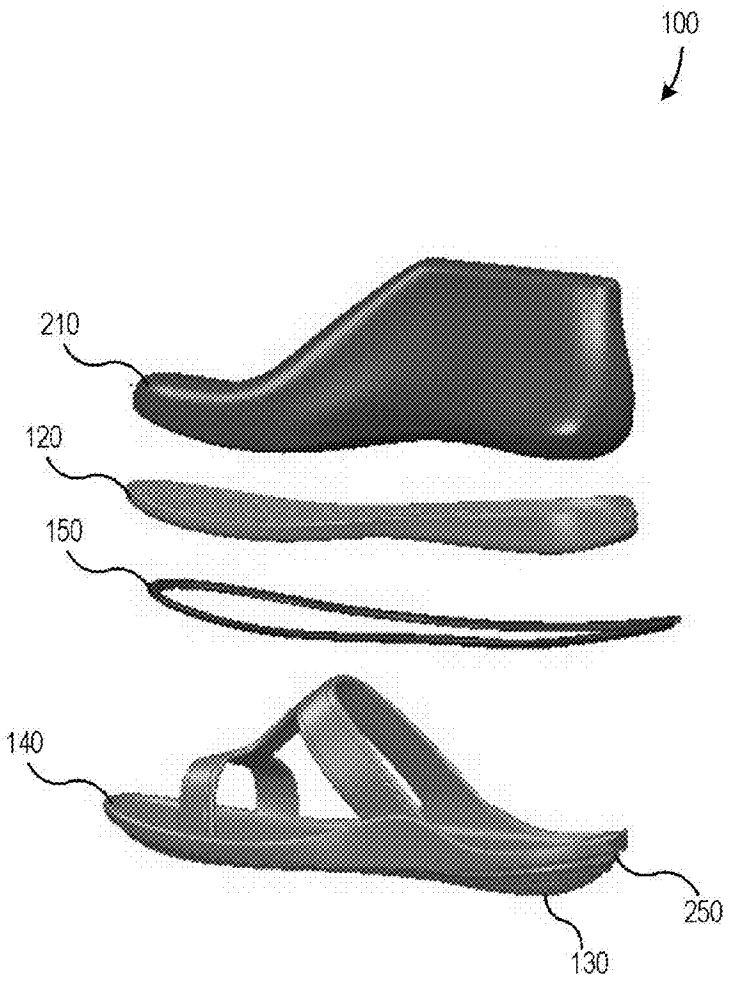
FIG. 2 is an isometric view of a last and disassembled toning sandal of FIG. 1.

FIG. 2 is an isometric view of a last 210 and disassembled toning sandal 100 of FIG. 1. The disassembled toning sandal 100 illustrated in FIG. 2, includes a footbed or insole 120, a support ring 150, and a sole 140. Sole 140 shows a support ring groove 250 which can be used in various embodiments of the present invention to receive support ring 150. According to embodiments of the present invention, after formation of the sole 140, the support band 150 is inserted over the outsole 130 from the bottom of the shoe 100, and snapped or snap fit into place over the outsole 130 along support ring groove 250. According to some embodiments, the support ring groove 250 is not present, and the support band 150 is simply snapped into placed over the outsole 130 and adhered to the outsole 130 at the appropriate location.

Figure 3:
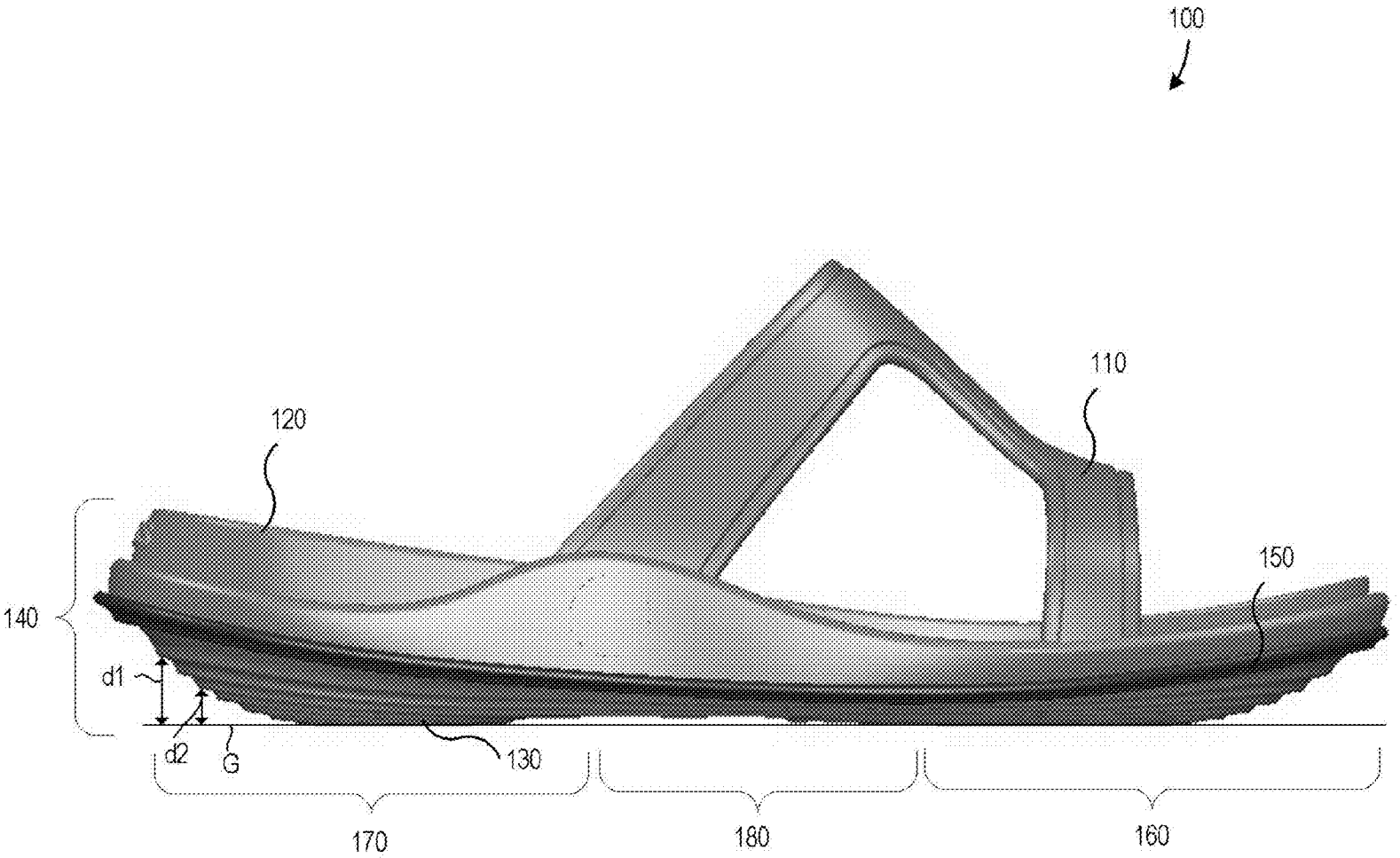
FIG. 3 is an outer side view of the toning sandal of FIG. 1.
Figure 4:
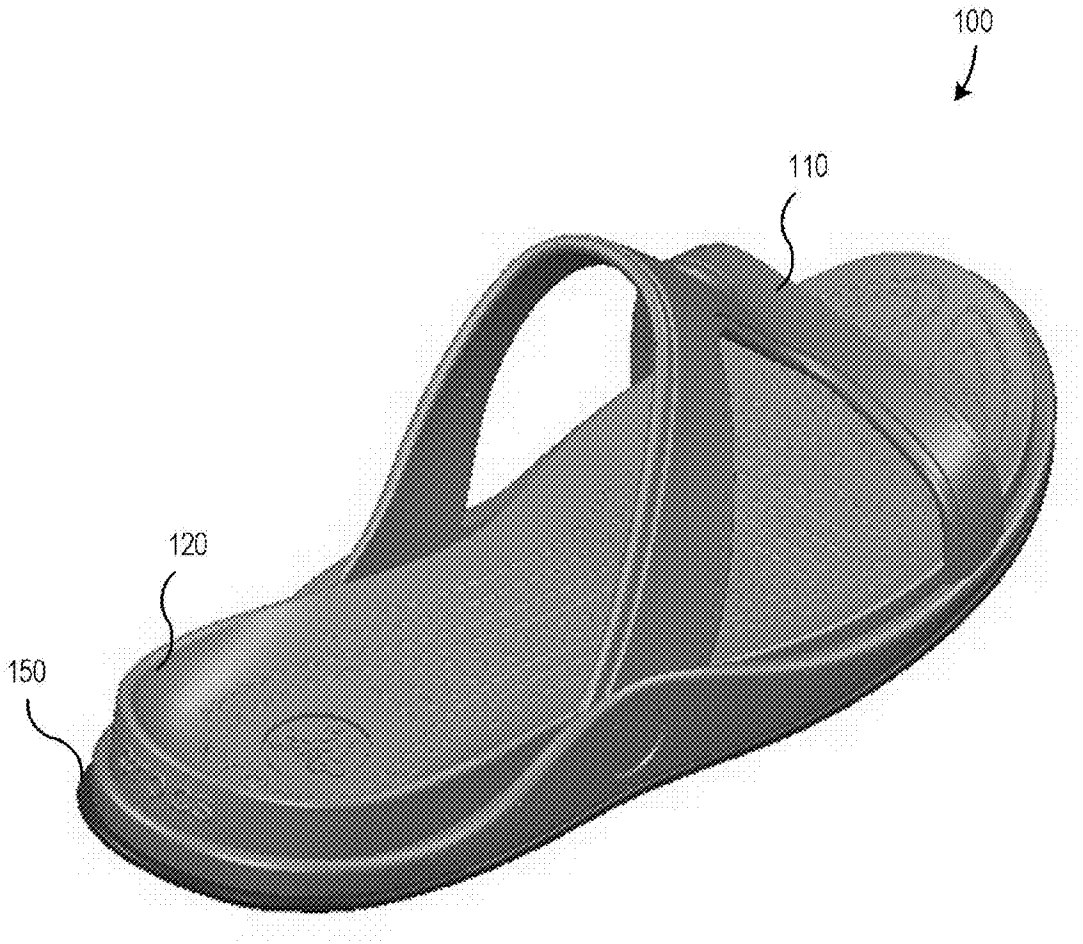
FIG. 4 is an isometric view showing the upper, the insole, and the support band of the toning sandal of FIG. 1.
Figure 5:
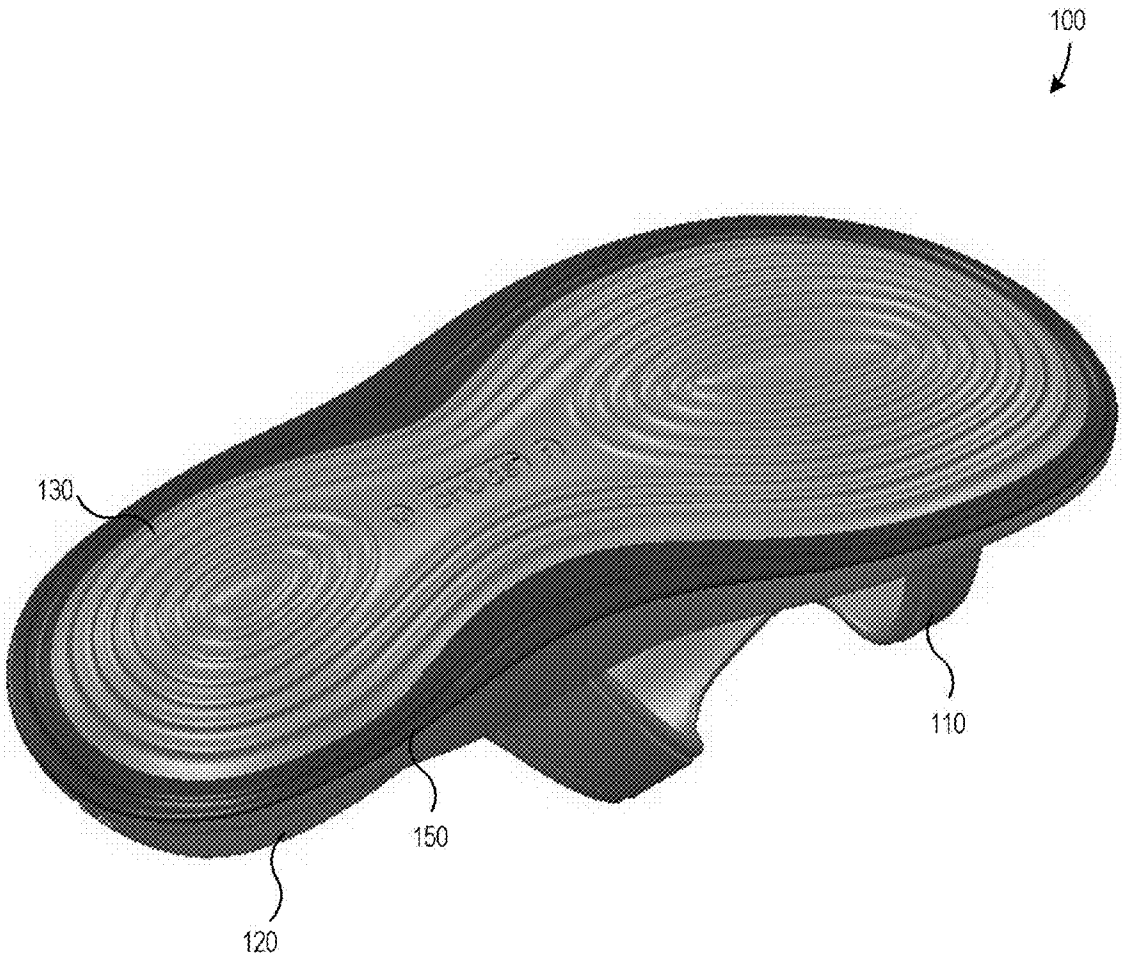
FIG. 5 is an isometric view showing the upper, the insole, the outsole, and the support band of the toning sandal of FIG. 1.

FIG. 3 is an outer side view of the toning sandal of FIG. 1. As illustrated in FIG. 1, toning sandal 100 includes upper 110, footbed (or insole) 120, outsole 130, sole 140, and support band 150. The outsole illustrated includes forefoot portion 160, heel portion 170, and midfoot portion 180. FIG. 4 is an isometric view showing the upper 110, insole 120, and support band 150 of the toning sandal 100 of FIG. 1. FIG. 5 is an isometric view showing the upper 110, insole 120, outsole 130, and support band 150 of the toning sandal of FIG. 1.

Figure 6:
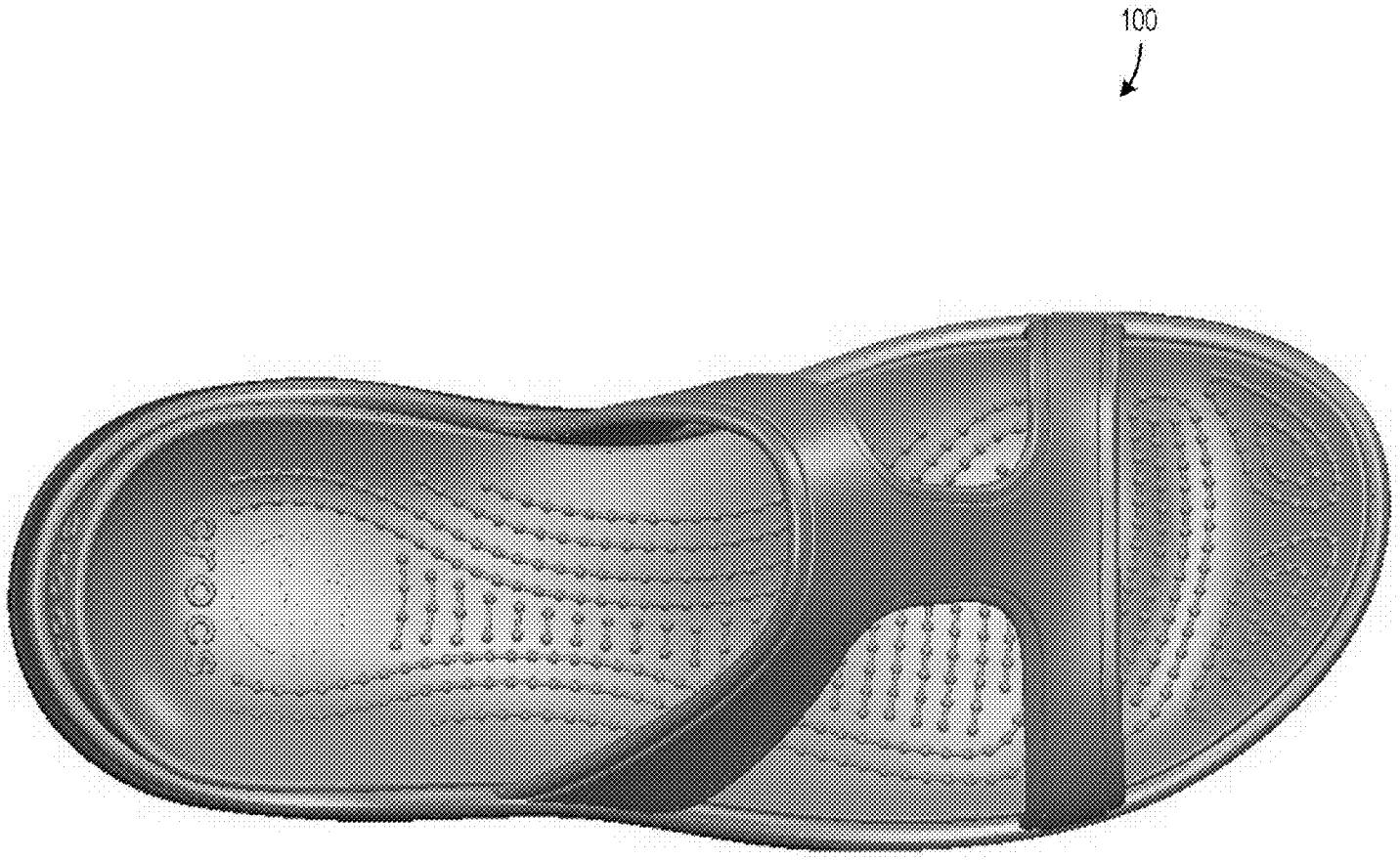
FIG. 6 is a top view of the toning sandal of FIG. 1.
Figure 7:
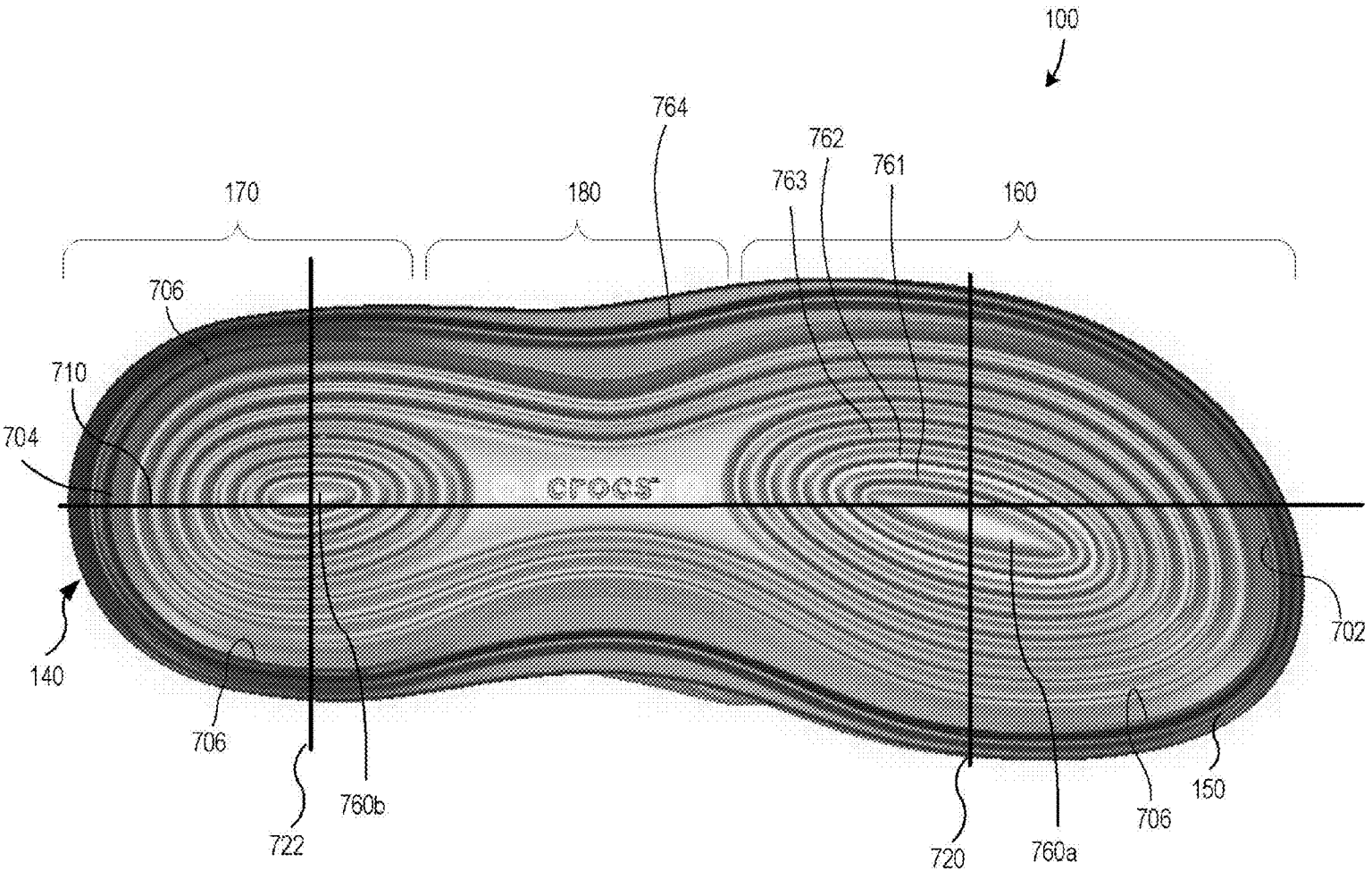
FIG. 7 is a bottom view of the toning sandal of FIG. 1.

FIG. 6 is a top view of the toning sandal of FIG. 1. FIG. 7 is a bottom view 700 of the toning sandal of FIG. 1. Longitudinal axis 710 and transverse axes 720, 722 are shown in FIG. 7. FIG. 7 shows forefoot portion 160, heel portion 170, and midfoot portion 180 between the forefoot portion 160 and heel portion 170. When the outsole 130 is set upon a flat ground surface, the outsole 130 contacts the flat ground surface at a forefoot contact area 760*a* of the forefoot portion 160 and at a heel contact area 760*b* of the heel portion 170.

Figure 20:
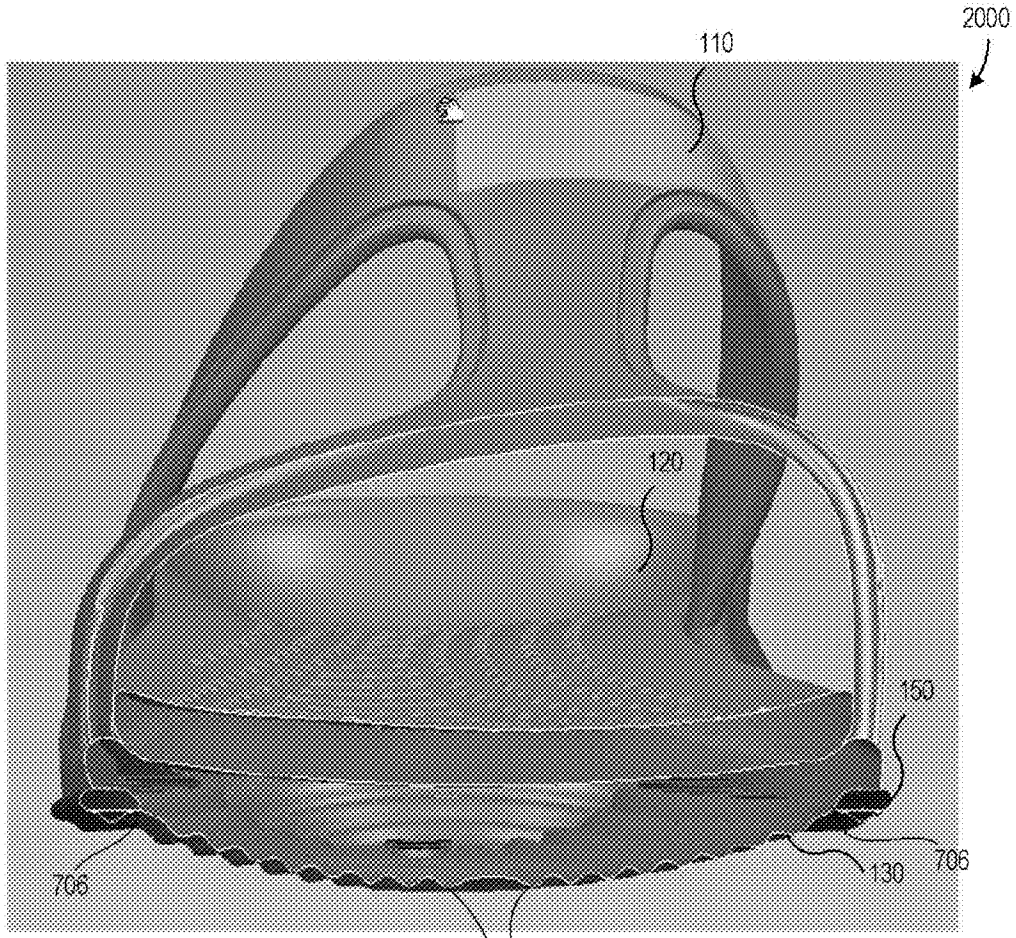
FIG. 20 illustrates a cross-sectional view of the toning sandal of FIG. 1 along a transverse plane in the forefoot portion of the footwear.
Figure 21:
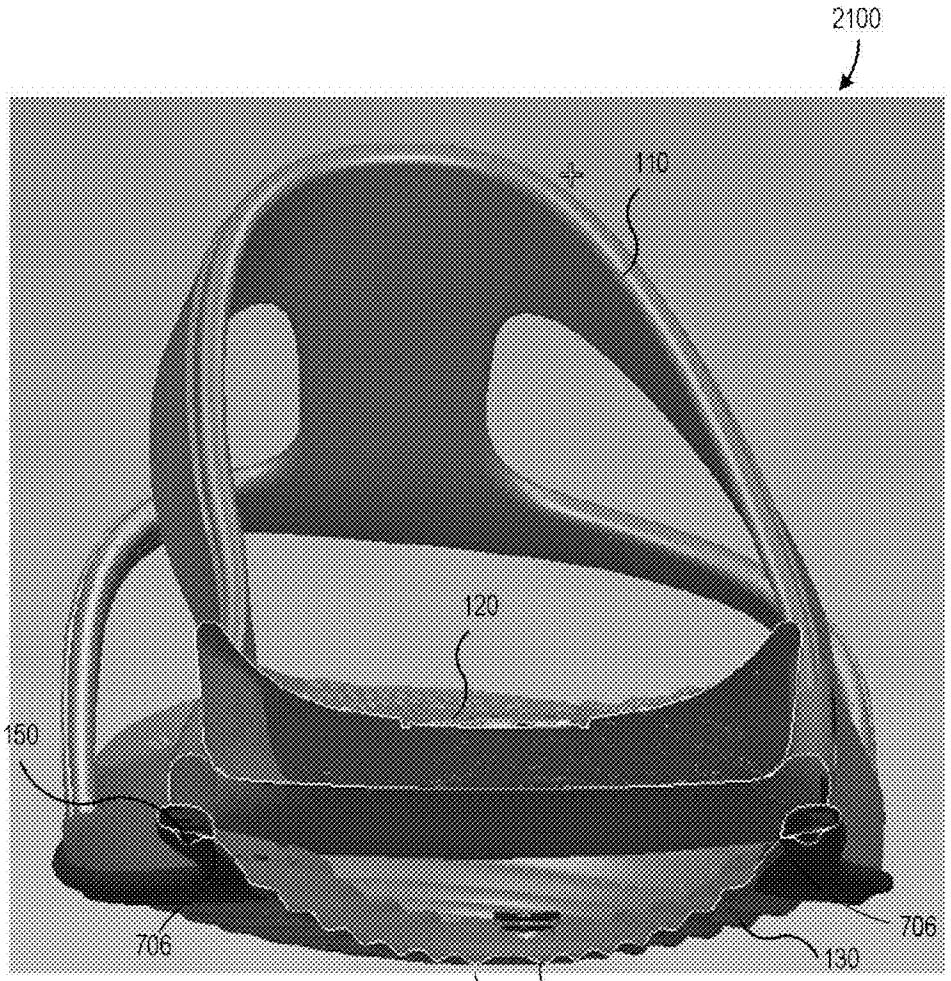
FIG. 21 illustrates a cross-sectional view of the toning sandal of FIG. 1 along a transverse plane in the heel portion of the footwear.

FIG. 3 illustrates an example of a flat ground surface G, and examples of distances d1 and d2 measured from the flat ground surface G to the heel portion 170, according to embodiments of the present invention. In some embodiments, along a first transverse plane 720 intersecting the forefoot contact area 760*a* (see FIGS. 3 & 7), a first distance measured perpendicularly to the flat ground surface G between the flat ground surface G and the forefoot portion 160 increases in both directions from the forefoot contact area 760*a* toward the outer perimeter 706, as also illustrated in FIG. 20. Along a second transverse plane 722 intersecting the heel contact area 760*b*, a second distance (e.g. d1, d2) measured perpendicularly to the flat ground surface G between the flat ground surface G and the heel portion 170 increases in both directions from the heel contact area 760*b* toward the outer perimeter 706 in some embodiments, as also illustrated in FIG. 21.

Figure 19:
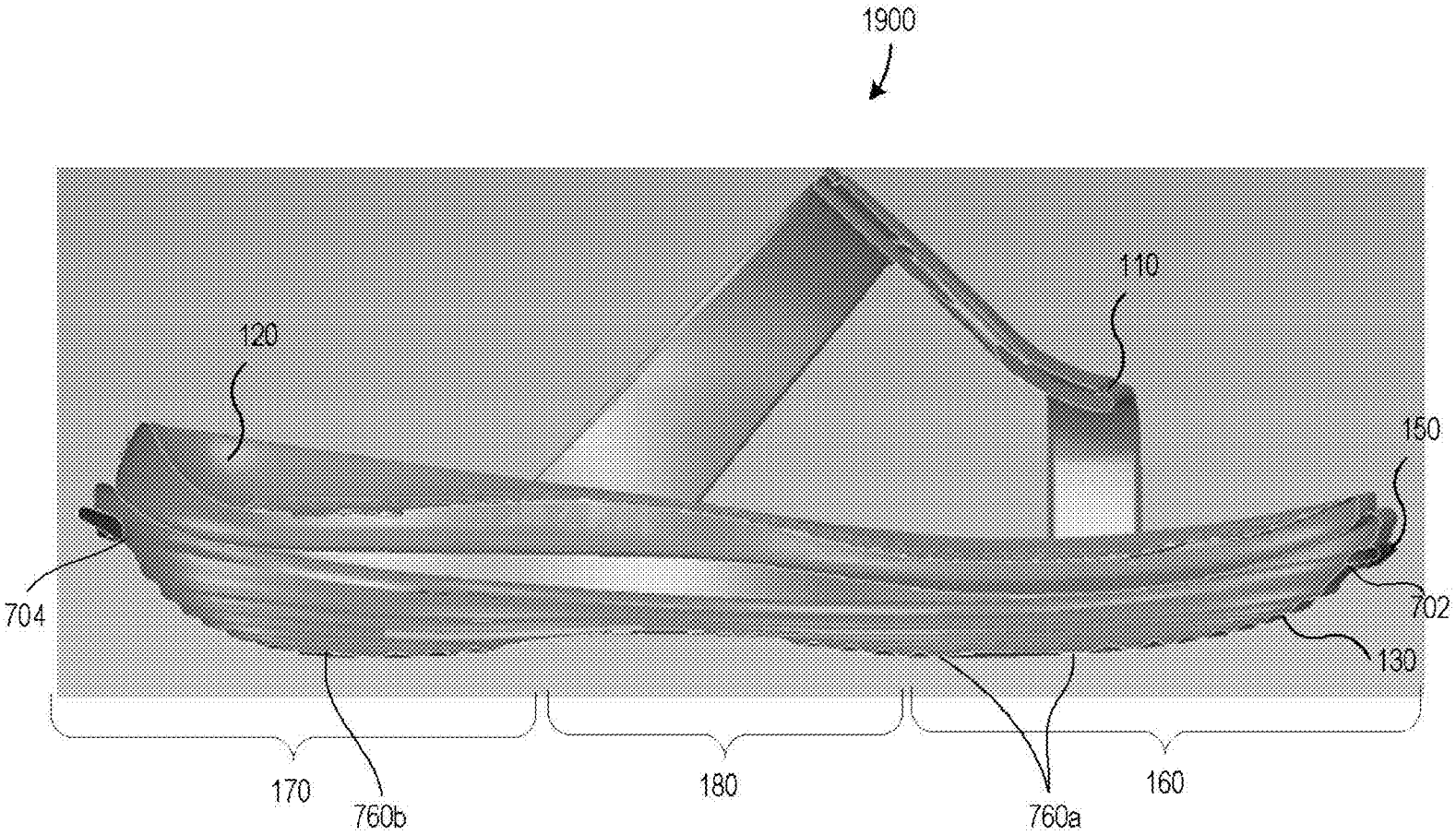
FIG. 19 illustrates a cross-sectional view of the toning sandal of FIG. 1 along a longitudinal plane of the footwear.

Longitudinal plane 710 intersects the forefoot contact area 760*a* and the heel contact area 760*b* and is orthogonal to both the first and second transverse planes 720, 722. In some embodiments, a third distance measured perpendicularly to the flat ground surface G between the flat ground surface G and the outsole 130 decreases from a front end 702 of the outer perimeter 706 toward the forefoot contact area 760*a*, increases from the forefoot contact area 760*a* toward the midfoot portion 180, decreases from the midfoot portion 180 toward the heel contact area 760*b*, and increases from the heel contact area 760*b* toward a back end 704 of the outer perimeter 706, as also illustrated in FIG. 19.

In accordance with various embodiments, support band 150 can be coupled to the outsole 130. In some embodiments, the outsole 130 can be made from a first material (e.g., ethylene-vinyl acetate) while the support band 150 can be formed of a second material (e.g., thermoplastic polyurethane) different from and stiffer than the first material. In addition, in some embodiments, the support band 150 can at least partially surround one or more of the heel portion 170, the forefoot portion 160, and the midfoot portion 180.

In the embodiment shown in FIG. 7, heel portion 170, forefoot portion 160, and midfoot portion 180 include contour ridges 761, 762, 763 in a concentric design. According to some embodiments, the first, second, third distances are measured from the lowest portion of the ridges (e.g. the portion of the ridges 761, 762, 763 closest to the ground surface G). In other embodiments, heel portion 170, forefoot portion 160, and midfoot portion 180 include concentric rings that may or may not correspond to level surfaces. As shown in FIG. 7, the concentric ridges or rings start at forefoot contact area 760*a* and heel contact area 760*b* and grow outwardly until the rings meet the midfoot portion 180. Once the rings meet the midfoot portion 180 a smooth surface is created in the midfoot portion and the rings located in the heel portion 170 and the forefoot portion 160 merge into larger rings or ridges roughly following or corresponding to the perimeter shape of the footwear. In other embodiments, a concentric ring pattern may be present in midfoot portion 180. In some embodiments, the support band 150 includes at least one contour ridge 764, and this contour ridge may have a shape similar to, but larger or wider than, the contour ridges 761, 762, 763 present on the outsole 130.

In accordance with various embodiments, the support band 150 minimizes the transmission of deflection forces from the outsole 130 to the insole 120/vamp 110 of the shoe 100. In some embodiments, the outsole 130 will be softer or substantially softer to allow for the toning benefit, but the overall deflection of the entire shoe 100 may be modified at the support band 150. The support band 150, in some embodiments, may also provide a lateral bound on the translation of the footwear to help prevent or deter the wearer from rolling an ankle and/or other injuries; in other words, when the shoe 100 is rolled to the inside or outside direction (lateral or medial), the support band 150 will contact the ground surface G to limit the lateral rotation. Hence, the softer outsole 130 provides beneficial muscle toning qualities by imparting an instability to the shoe. The rounded or convex heel portions 170 and forefoot portions 160 also impart an instability to the shoe to provide beneficial muscle toning during use.

The support band 150, which is formed of a material or a structure that is stiffer, or is substantially stiffer, than the material of the outsole 130, helps provide lateral and/or vertical stability to the overall shoe 100. In that manner, the user may receive the toning benefit created by the instabilities of the outsole 130 while still benefiting from a shoe that is stable overall because of the stiffness of the band 150, according to embodiments of the present invention. The support band may be an open band or ring 150, which increases the structural stability of the shoe 100 while not interfering with the comfort of the materials between the user's foot and the ground surface G, because the support band 150 extends around a perimeter 702 of the outsole 130, according to embodiments of the present invention. Thus, a more soft and/or comfortable EVA-based material may be used for the insole 120 and/or outsole 130, to provide the toning and comfort benefits, while a harder and/or stiffer TPU-based material may be used for the support band 150, according to embodiments of the present invention. Some embodiments of the present invention do not include a support band 150.

In some embodiments, forefoot portion 160 and heel portion 170 include toning convexities. The angle created by the convexities can vary between the heel and forefoot portions. In some embodiments, the angles of the convexities in forefoot portion 160 and heel portion 170 may be the same. The angles created by the convexities may be uniform or may vary from the contact points 760*a*, 760*b* inward toward the insole according to various embodiments of the present invention.

In some embodiments, support band 150 may be positioned further from the flat ground surface than any portion of the forefoot portion 160 and the heel portion 170. The support band 150 can be wider in a first location adjacent to the midfoot portion 180 than in a second location adjacent to the front end 702 of the outer perimeter 706 according to some embodiments. The support band 150 can also be wider in the first location than in a third location adjacent to the back end 704 of the outer perimeter 706.

Figure 8:
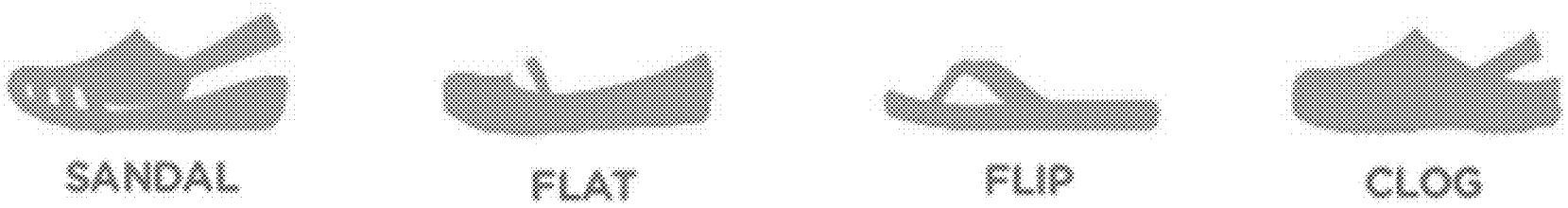
FIG. 8 illustrates side views of examples of various types of uppers or vamps that may be used with the toning footwear of embodiments of the present invention.
Figure 9:
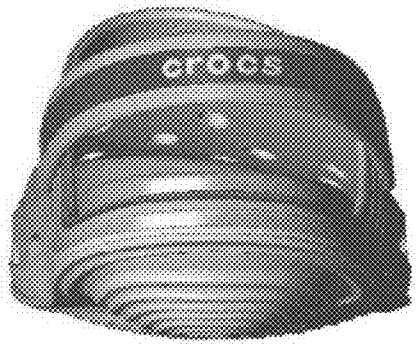
FIG. 9 is a rear view of a toning clog in accordance with some embodiments of the invention.
Figure 10:
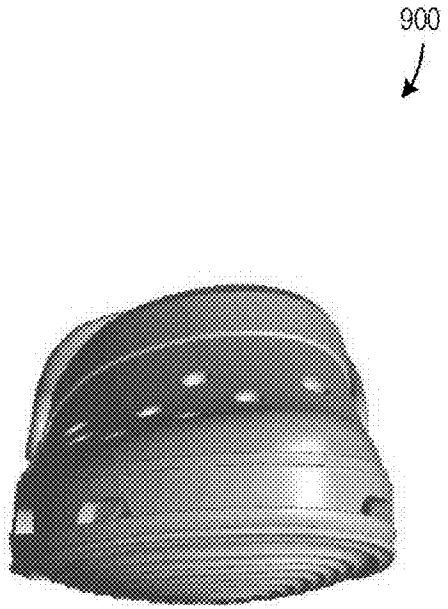
FIG. 10 is a front view of the toning clog of FIG. 9.
Figures 11A, 11B:
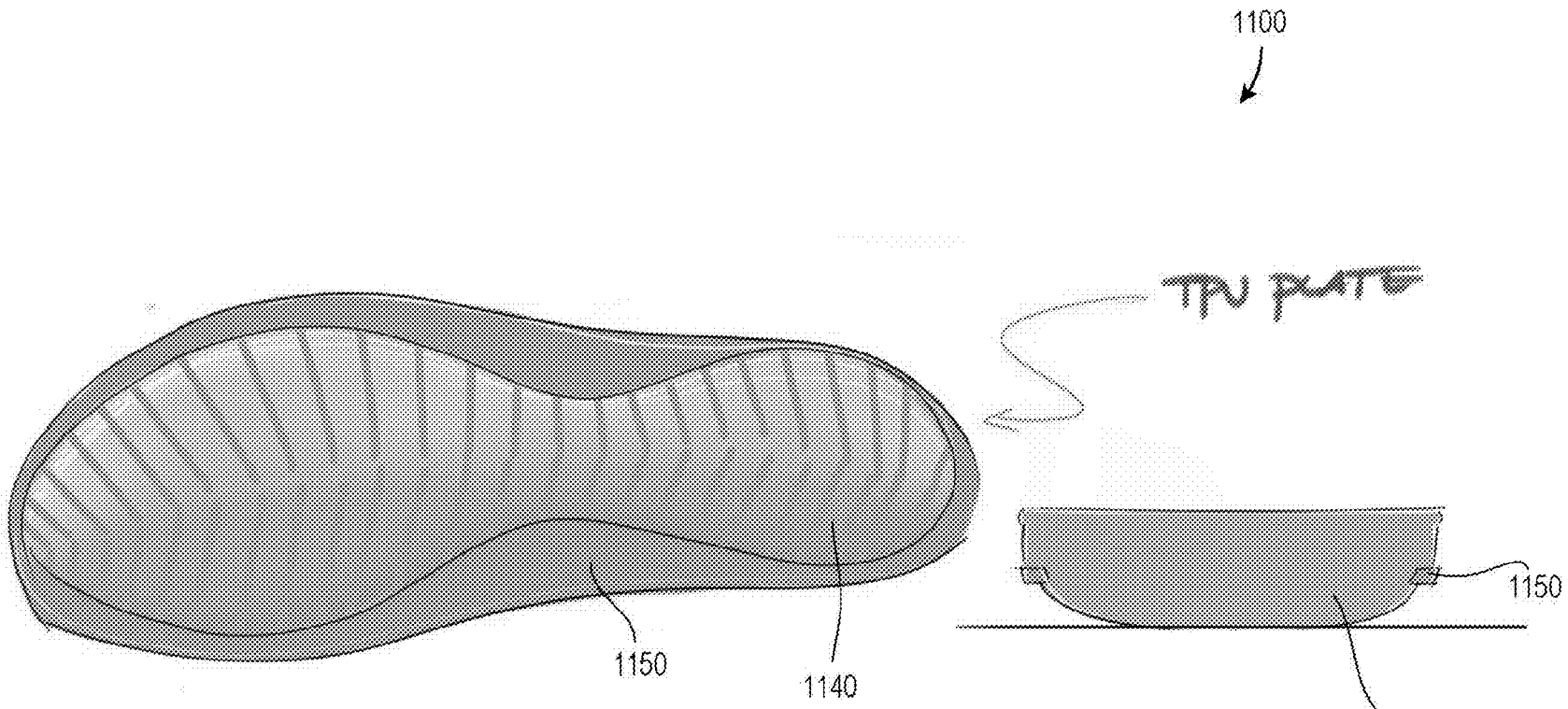
FIGS. 11A and 11B illustrate a bottom view and a back view of a toning footwear according to various embodiments of the present invention.

As described above, the upper of the toning footwear can take a variety of configurations. FIG. 8 illustrates side views of examples of various types of uppers that may be used with the toning footwear of embodiments of the present invention. As illustrated in FIG. 8, the upper of the toning footwear can be a sandal, a flat, a flip-flop, or a clog. Of course, other embodiments of the present invention may have other types of uppers known to those of ordinary skill in the art. FIGS. 9 and 10 are a rear view and a front view of a toning clog 900 in accordance with some embodiments of the invention. While the upper portion of the toning footwear may vary, the sole remains similar according to various embodiments of the present invention. For example, the sole portion illustrated in FIGS. 9 and 10 may be used with the upper 110 of FIGS. 1-7. FIGS. 11A and 11B illustrate the bottom and back views of toning footwear, including a sole 1140 and a support band 1150, according to various embodiments of the present invention.

Figure 12:
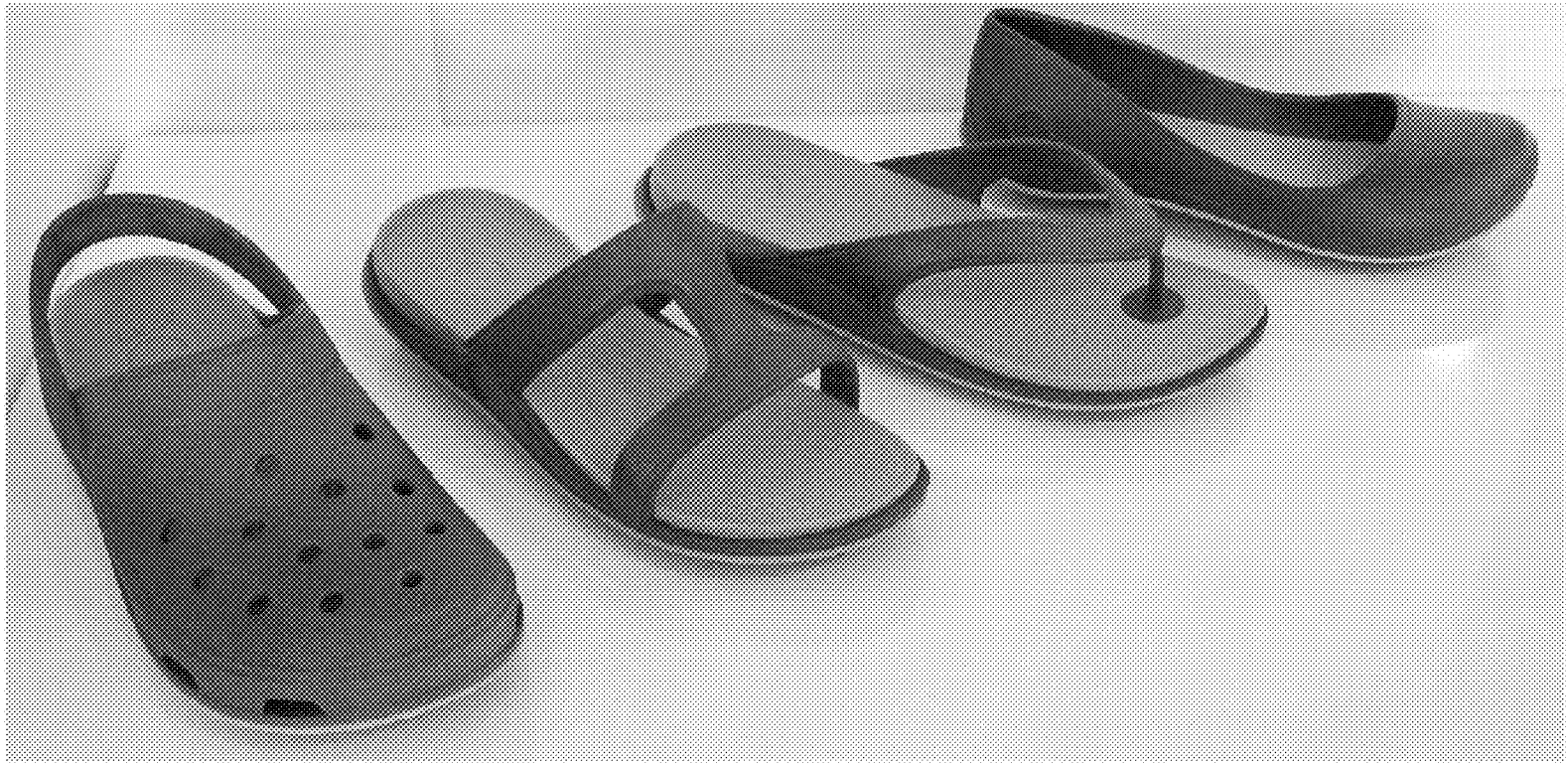
FIG. 12 illustrates outer perspective views of examples of various types of uppers that may be used with the toning footwear of embodiments of the present invention.
Figure 13:
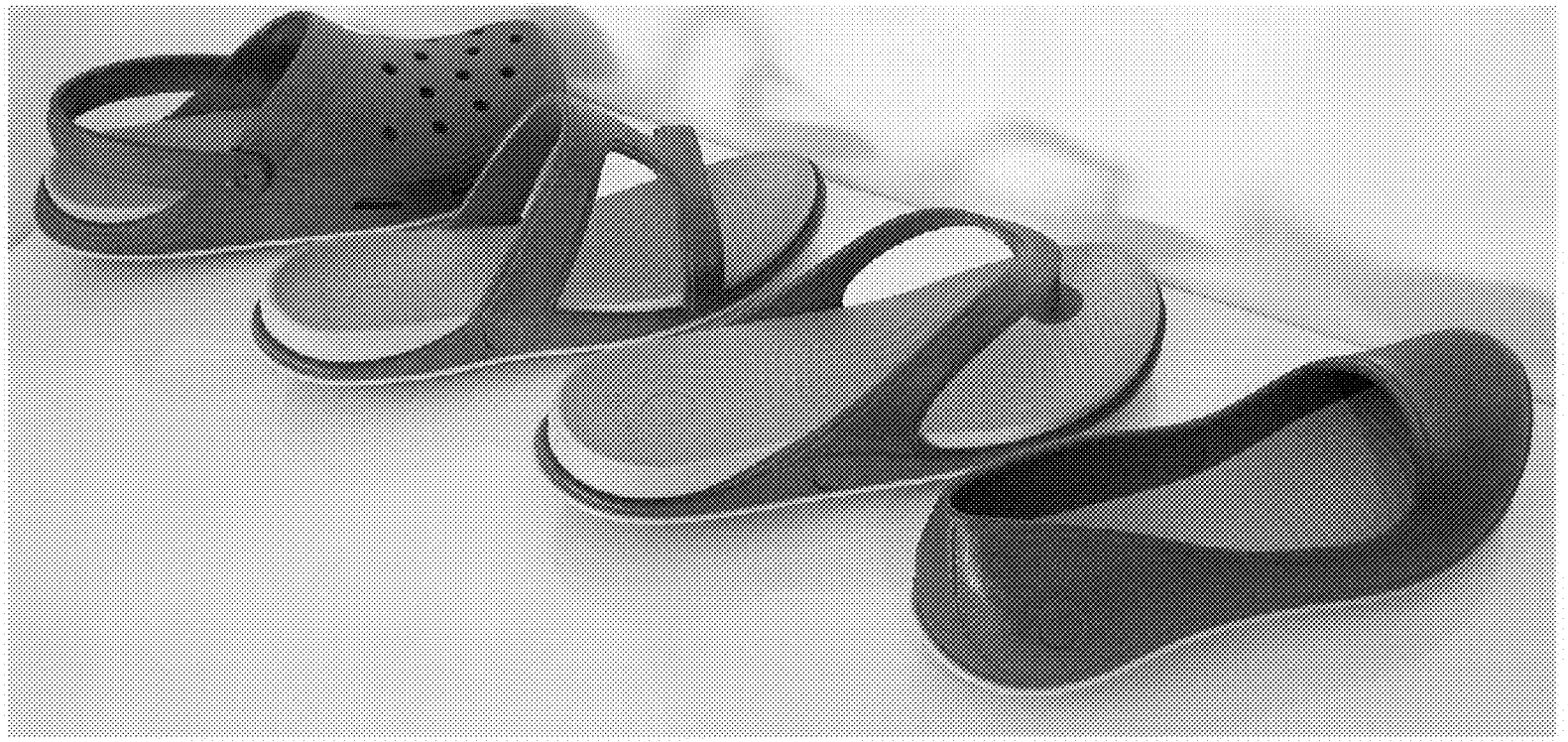
FIG. 13 illustrates side perspective views of the footwear in FIG. 12.
Figure 14:
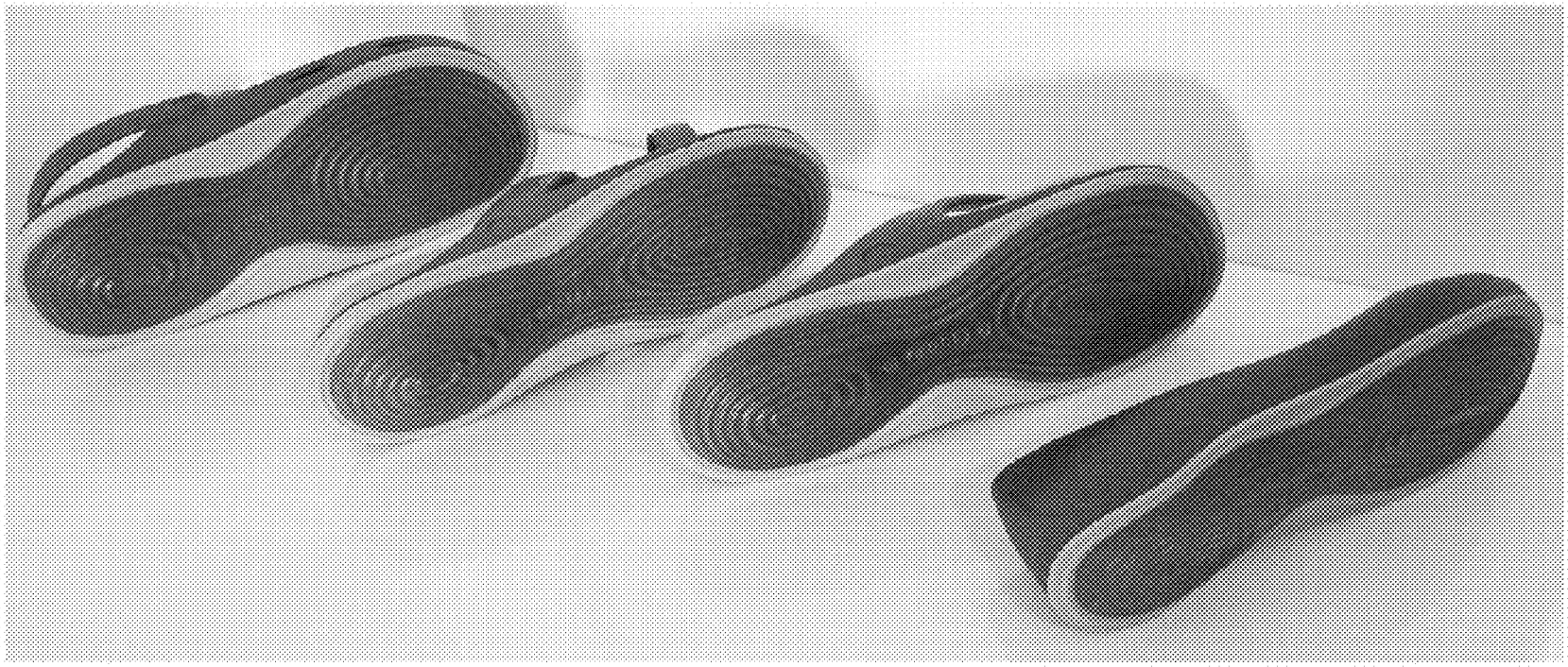
FIG. 14 illustrates bottom perspective views of the footwear in FIG. 12.

FIG. 12 illustrates outer perspective views of exemplary uppers that may be used with the toning footwear of embodiments of the present invention. FIG. 13 illustrates side perspective views of the footwear in FIG. 12. FIG. 14 illustrates bottom perspective views of the footwear in FIG. 12.

Figure 15:
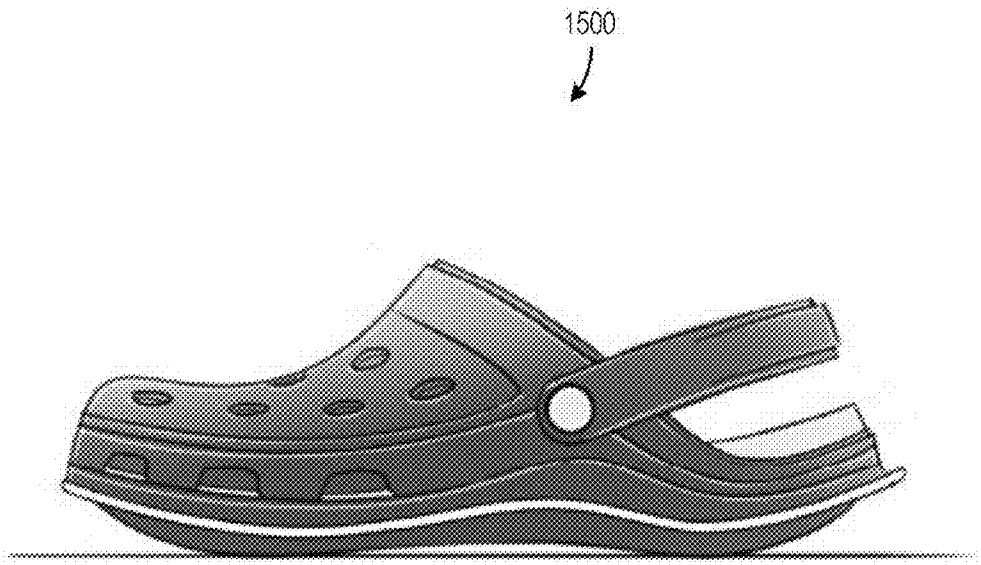
FIG. 15 illustrates a side view of toning clog footwear according to some embodiments of the present invention.
Figure 16:
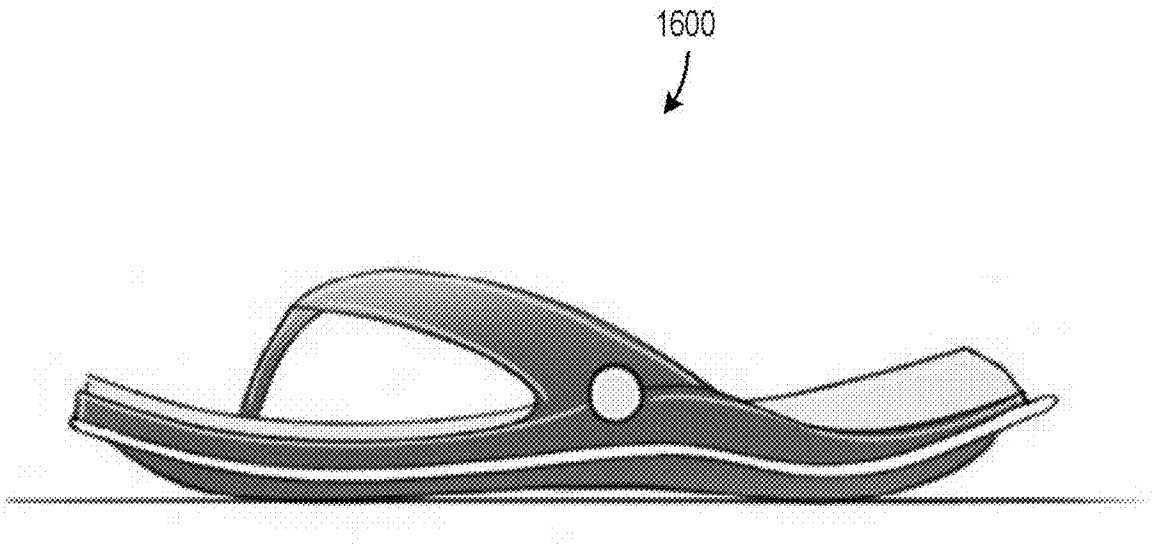
FIG. 16 illustrates a side view of toning flip-flop footwear according to one or more embodiments of the present invention.
Figure 17:
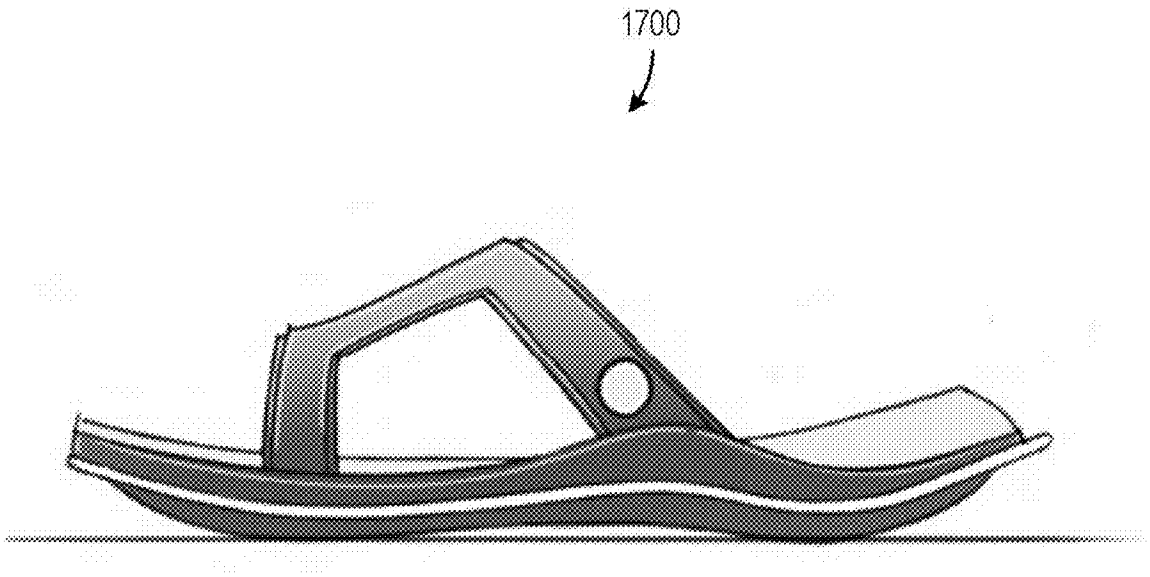
FIG. 17 illustrates a side view of toning sandal footwear according to various embodiments of the present invention.
Figure 18:
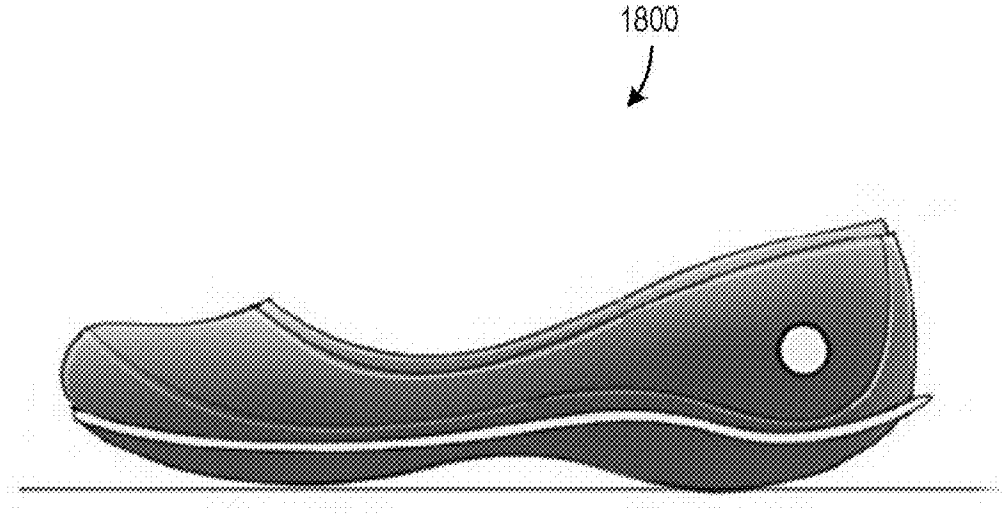
FIG. 18 illustrates a side view of toning flat footwear according to embodiments of the present invention.

FIG. 15 provides a side view of toning clog 1500 footwear according to some embodiments of the present invention. FIG. 16 is a side view of toning flip-flop footwear 1600 according to one or more embodiments of the present invention. FIG. 17 provides a side view of toning sandal footwear 1700 according to various embodiments of the present invention. FIG. 18 provides a side view of toning flat footwear 1800 according to embodiments of the present invention.

FIG. 19 illustrates a cross-sectional view of the toning sandal of FIG. 1 taken along longitudinal plane 710 of FIG. 7. FIG. 20 illustrates a cross-sectional view of the toning sandal of FIG. 1 taken along the transverse plane 720 of FIG. 7. FIG. 21 illustrates a cross-sectional view of the toning sandal of FIG. 1 taken along the transverse plane 722 of FIG. 7.

Figure 22:
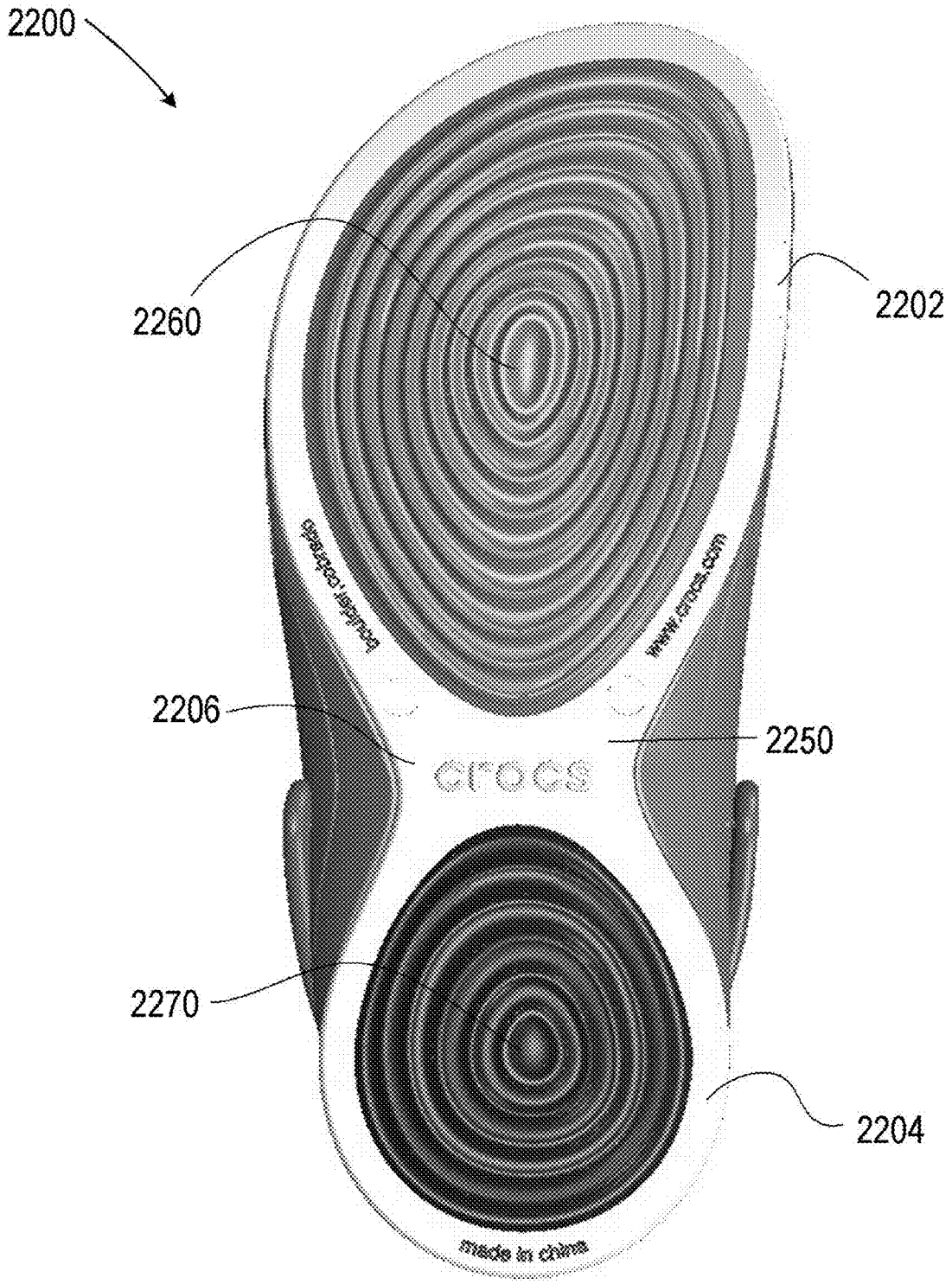
FIG. 22 is a bottom view of a toning clog in accordance with some embodiments of the invention.

FIG. 22 illustrates a bottom view of a toning clog 2200 according to some embodiments of the present invention. As shown in FIG. 22, the support band 2250 may comprise two rings 2202 and 2204 joined by a support section 2206. In FIG. 22, the support band 2250 forms a figure-eight pattern that encloses the forefoot portion 2260 and the heel portion 2270.

Figure 23:
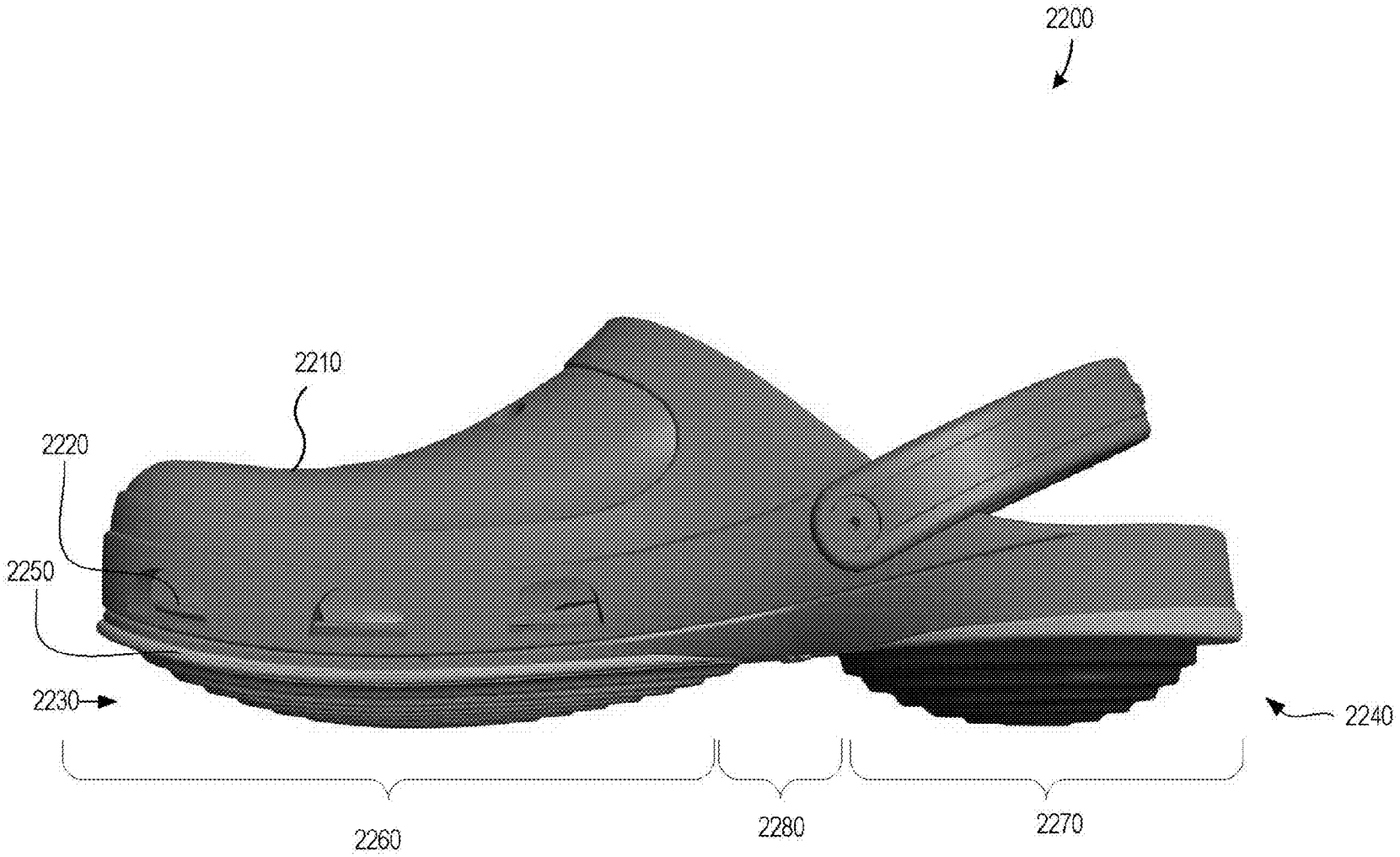
FIG. 23 is an inner side view of the toning clog of FIG. 22.

As illustrated in FIG. 23, toning clog 2200 may include an upper 2210 and a sole 2240. The sole 2240 includes a footbed (or insole) 2220, outsole 2230, and support band 2250. Support band 2250 may also be referred as a support ring or a stiffener band or a plate. The footbed (or insole) 2220 is configured to contact the wearer's foot and may include various cushioning and support components and/or designs.

In some embodiments, support band 2250 may be secured to the footwear via a snap fit. In other embodiments, support band 2250 may be integrally formed with the footwear or secured via an adhesive. In accordance with some embodiments, support band 2250 can add a structural rigidity or stiffness to the footwear. As a result, the shoe will bend easier when the band is not present. In some embodiments, support band 2250 can have a uniform or varying width and may include one or more ridges.

In accordance with various embodiments, support band 2250 can be coupled to the outsole 2230. In some embodiments, the outsole can be made from a first material (e.g., ethylene-vinyl acetate) while the support band 2250 can be formed of a second material (e.g., thermoplastic polyurethane) different from and stiffer than the first material. In addition, in some embodiments, the support band 2250 can at least partially surround one or more of the heel portion 2270 and the forefoot portion 2260, as illustrated in FIG. 22. As will be described in more detail below, the outsole 2230 can include one or more portions with one or more toning convexity regions to increase the toning and/or strengthening of the calves, hamstrings and/or glutes from the gait cycle of a wearer. The convexity regions are configured to create an instability that requires the wearer to activate the calves, hamstrings and/or glutes to a greater degree when compared to traditional footwear. As illustrated in FIG. 23, the sole includes a forefoot portion 2260, a heel portion 2270, and a midfoot portion 2280, with each portion configured to increase toning and/or strengthening of various muscles. In some embodiments, forefoot portion 2260, and heel portion 2270 are formed of a resin molded foam material, and may be formed integrally. In other embodiments, the forefoot portion and heel portions are formed as distinct components secured to the footwear through adhesive, a snap fit, or other attachment mechanisms.

Figure 24:
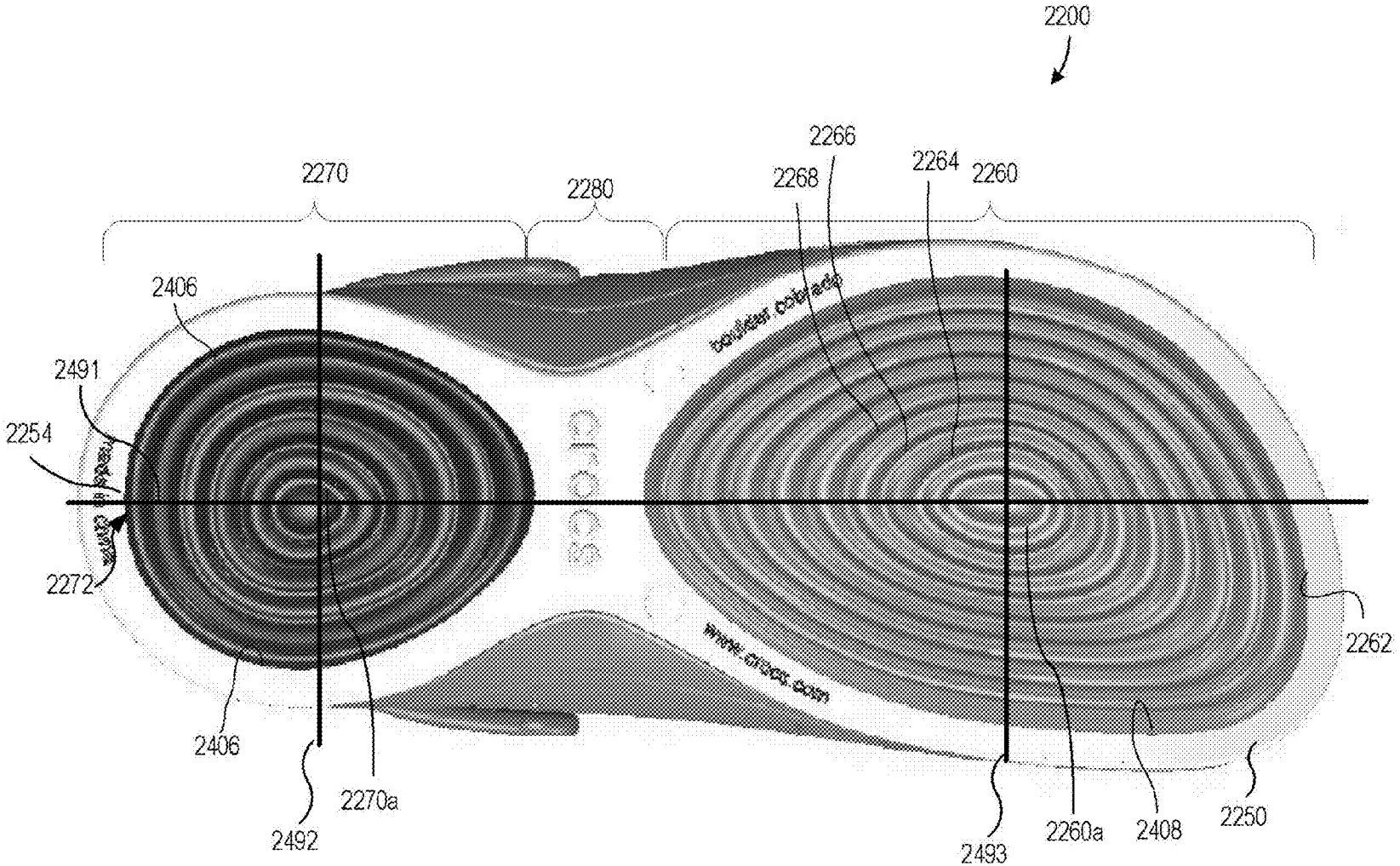
FIG. 24 is another bottom view of the toning clog of FIG. 22.

FIG. 24 is a bottom view of the toning clog 2200. Longitudinal axis 2491 and transverse axes 2492, 2493 are shown in FIG. 24. The longitudinal axis 2491 intersects the forefoot contact area 2260*a* and the heel contact area 2270*a* and is orthogonal to both the first and second transverse axes 2492, 2493. The sole 2240 comprises a forefoot outer perimeter 2408 where the inner edge of the support band 2250 contacts the outer extent of the forefoot portion 2260. The sole 2240 further comprises a heel outer perimeter 2406 wherein the inner edge of the support band 2250 contacts the outer extent of the heel portion 2270. FIG. 24 also shows forefoot portion 2260, heel portion 2270, and midfoot portion 2280. When the outsole 2230 is set upon a flat ground surface, the outsole contacts the flat ground surface at a forefoot contact area 2260*a* of the forefoot portion 2260 and at a heel contact area 2270*a* of the heel portion 2270.

Figure 25:
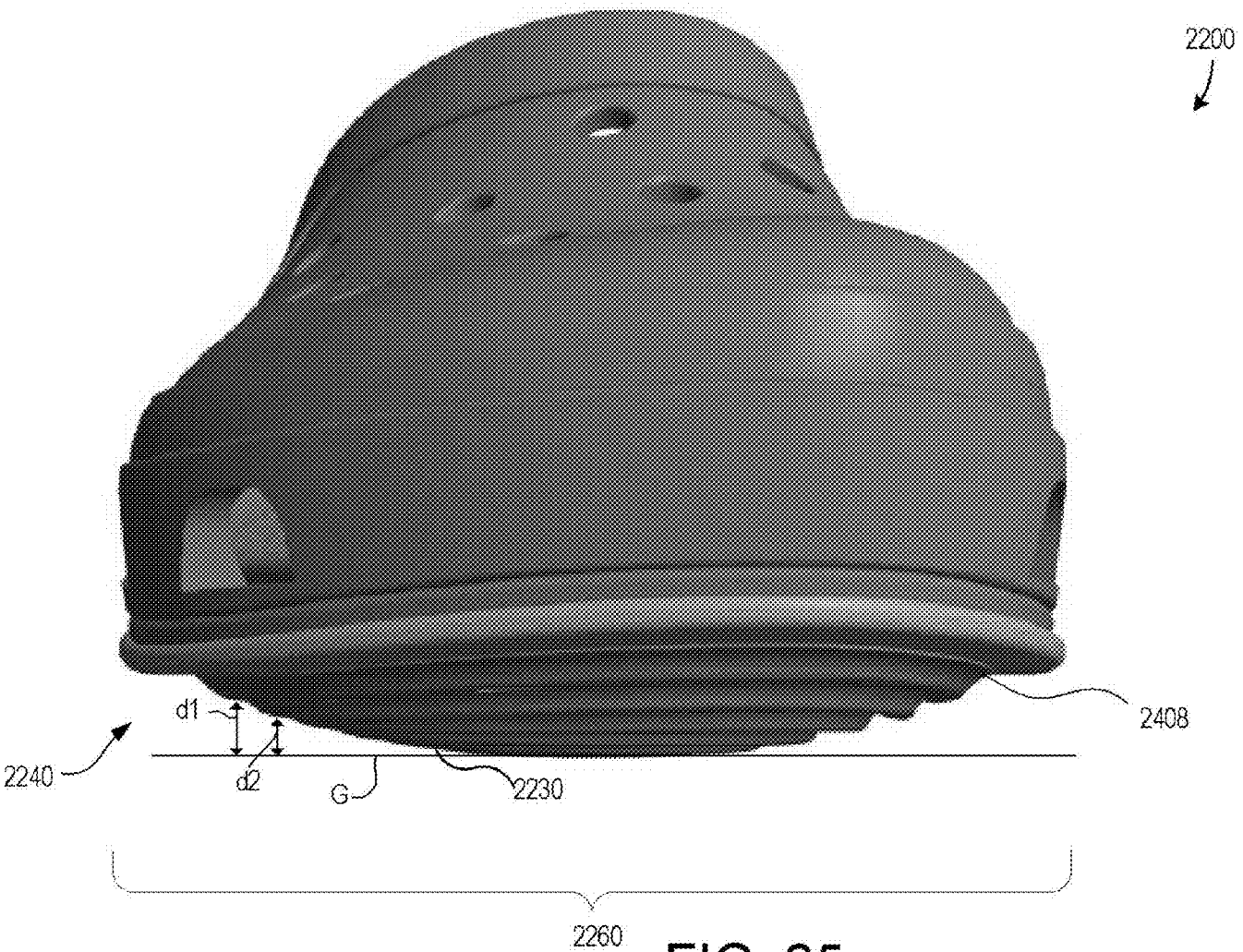
FIG. 25 is a front view of the toning clog of FIG. 22.
Figure 26:
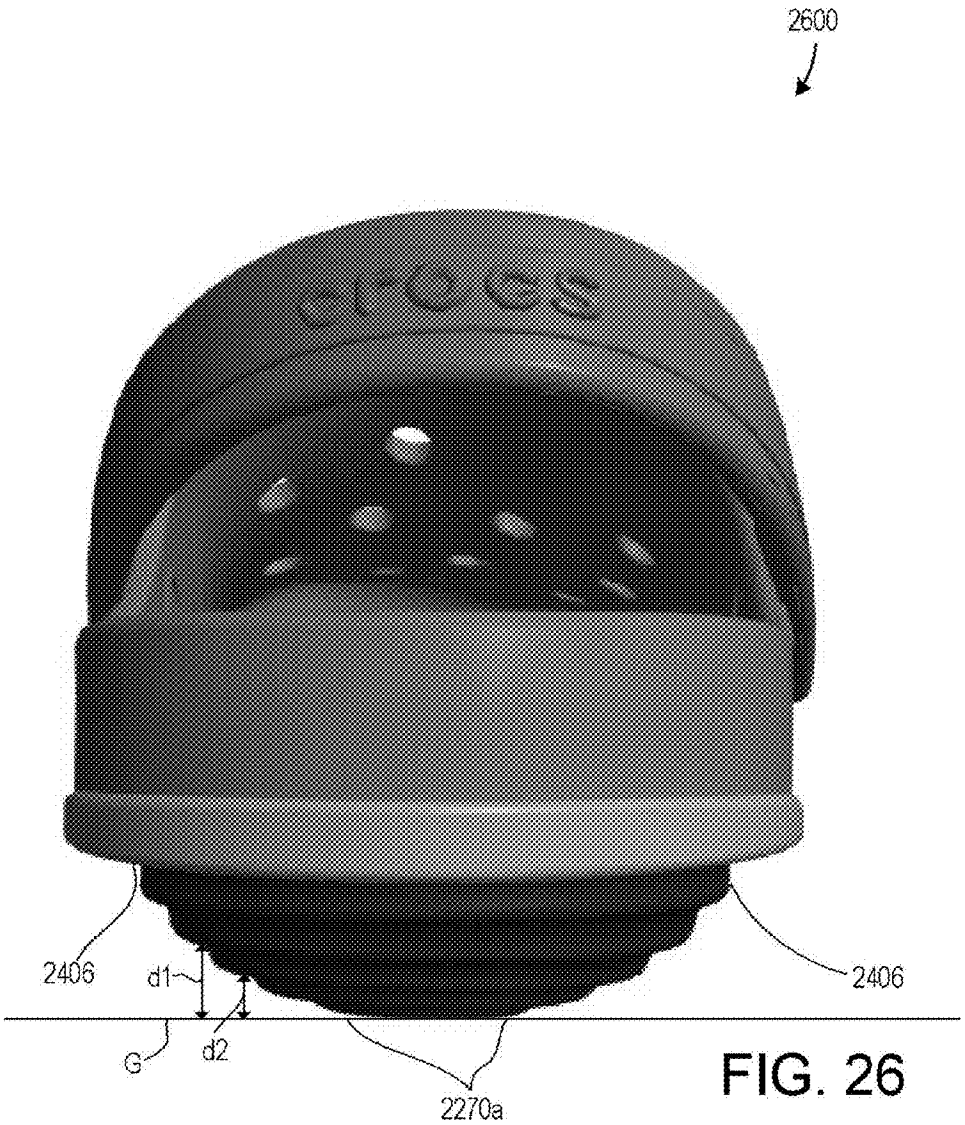
FIG. 26 is a back view of the toning clog of FIG. 22.

FIG. 25 illustrates an example of a flat ground surface G, and examples of distances d1 and d2 measured from the flat ground surface G to the forefoot portion 2260, according to embodiments of the present invention. In some embodiments, along a first transverse axis 2493 intersecting the forefoot contact area 2460*a* (see FIGS. 24 & 25), a first distance measured perpendicularly to the flat ground surface G between the flat ground surface G and the forefoot portion 2260 increases in both directions from the forefoot contact area 2260*a* toward the outer perimeter 2408. As shown in FIG. 26, along a second transverse axis 2492 intersecting the heel contact area 2270*a*, a second distance (e.g., d1, d2) measured perpendicularly to the flat ground surface G between the flat ground surface G and the heel portion 2270 increases in both directions from the heel contact area 2270*a* toward the outer perimeter 2406 in some embodiments.

Figure 27:
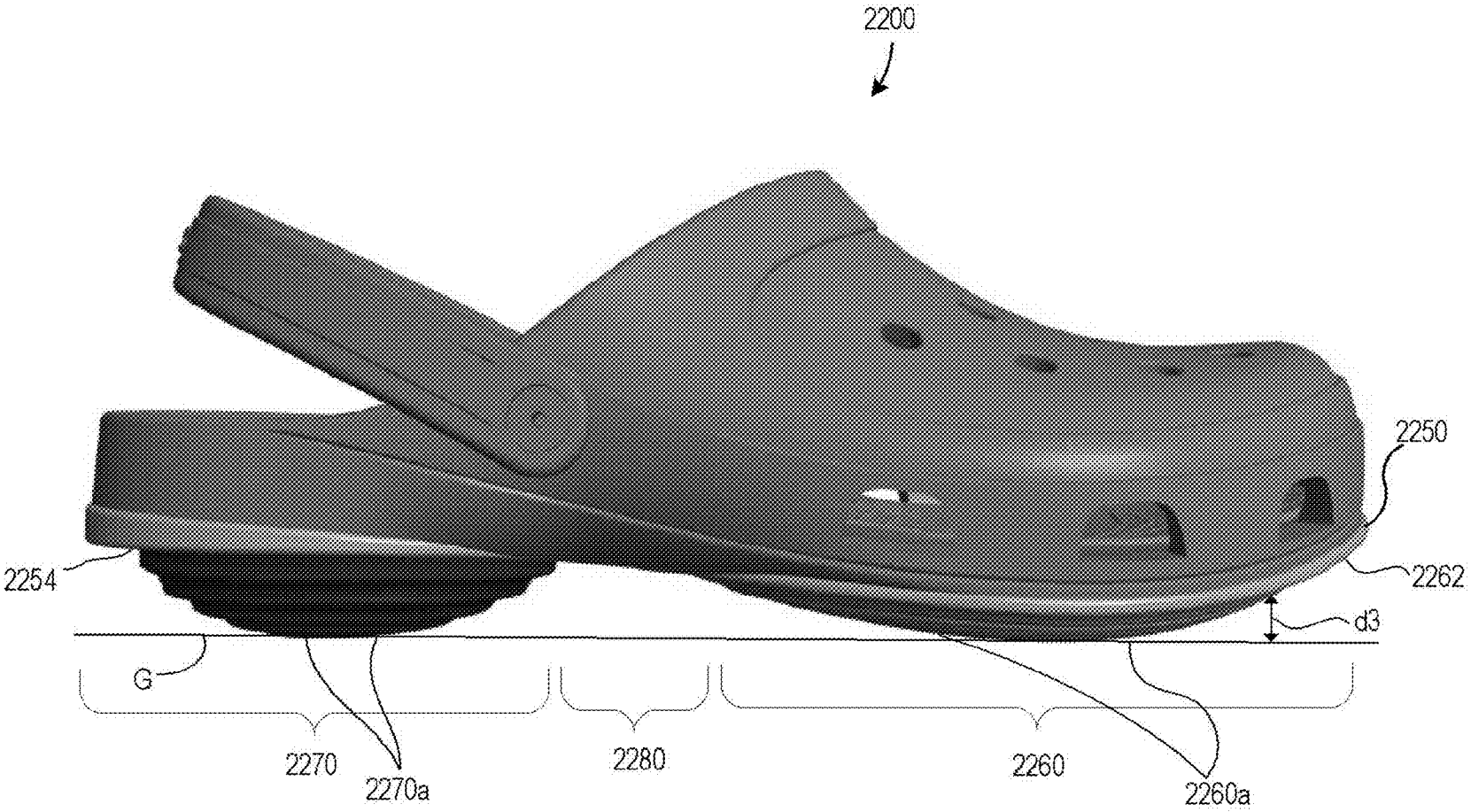
FIG. 27 is an outer side view of the toning clog of FIG. 22.
Figure 28:
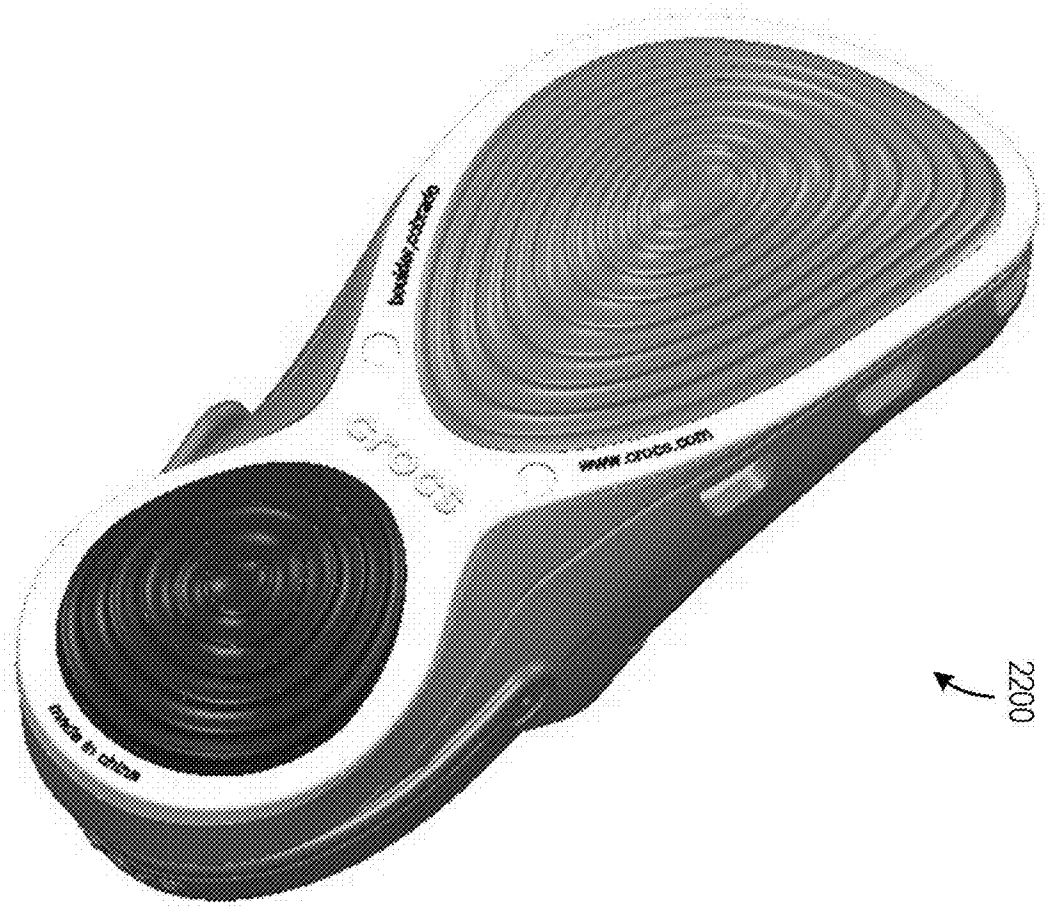
FIG. 28 is a bottom perspective view of the toning clog of FIG. 22.

As illustrated in FIG. 27, a third distance measured perpendicularly to the flat ground surface G between the flat ground surface G and the outsole 2230 decreases from a front end 2262 of the outer perimeter 2408 toward the forefoot contact area 2260*a*, increases from the forefoot contact area 2260*a* toward the midfoot portion 2280, decreases from the midfoot portion 2280 toward the heel contact area 2270*a*, and increases from the heel contact area 2270*a* toward a back end 2254 of the outer perimeter 2406.

Forefoot portion 2260 includes contour ridges 2264, 2266, 2268 in a concentric design, according to embodiments of the present invention. The heel portion 2270 may also include contour ridges in a concentric design. According to some embodiments, the first, second, and third distances are measured from the lowest portion of the ridges (e.g. the portion of the ridges 2264, 2266, 2268 closest to the ground surface G). In other embodiments, heel portion 2270 and forefoot portion 2260 include concentric rings that may or may not correspond to level surfaces. In yet other embodiments, contour ridges may be fastened on the midfoot portion 2280. As shown in FIG. 24, the concentric ridges or rings start at forefoot contact area 2260*a* and grow outwardly until the rings meet the forefoot perimeter 2408. The heel portion 2270 may have a similar arrangement of concentric ridges or may incorporate an alternative arrangement of ridges or other toning convexities. In some embodiments, the support band 2250 may include at least one contour ridge, and this contour ridge may have a shape similar to, but larger or wider than, the contour ridges 2264, 2266, 2268 present on the outsole 2230.

In accordance with various embodiments, the support band 2250 minimizes the transmission of deflection forces from the outsole 2230 to the insole 2220 of the shoe 2200. In some embodiments, the outsole 2230 will be softer or substantially softer to allow for the toning benefit, but the overall deflection of the entire shoe 2200 may be modified at the support band 2250. The support band 2250, in some embodiments, may also provide a lateral bound on the translation of the footwear to help prevent or deter the wearer from rolling an ankle and/or other injuries; in other words, when the shoe 2200 is rolled to the inside or outside direction (lateral or medial), the support band 2250 will contact the ground surface G to limit the lateral rotation. Hence, the softer outsole 2230 provides beneficial muscle toning qualities by imparting instability to the shoe. The rounded or convex heel portions 2270 and forefoot portions 2260 also impart instability to the shoe to provide beneficial muscle toning during use.

In some embodiments, support band 2250 can be positioned further from the flat ground surface than any portion of the forefoot portion 2260 and the heel portion 2270. The support band 2250 can be wider in a first location adjacent to the midfoot portion 2280 than in a second location adjacent to the front end 2262 of the outer perimeter 2408 according to some embodiments. The support band 2250 can also be wider in the first location than in a third location adjacent to the back end 2254 of the outer perimeter 2406.

Figure 29:
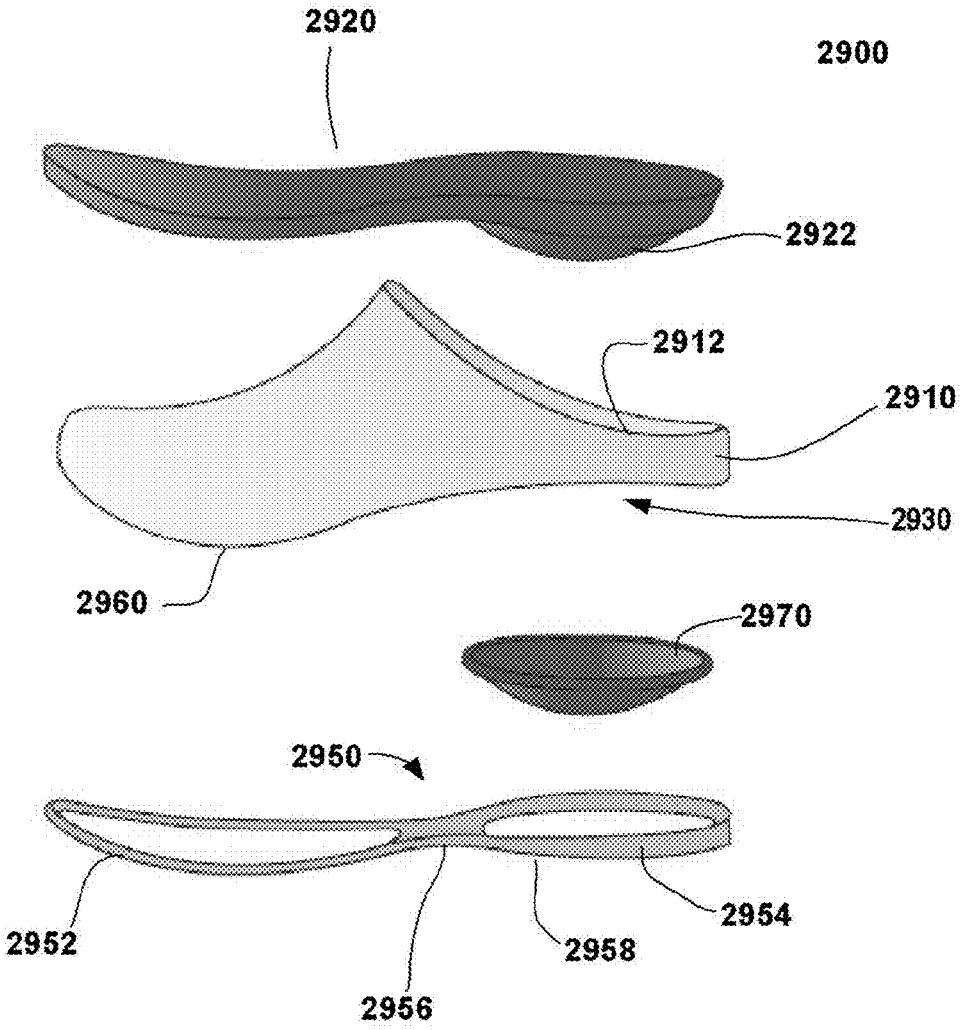
FIG. 29 is an exploded isometric view of a toning clog in accordance with some embodiments of the invention.
Figure 30:
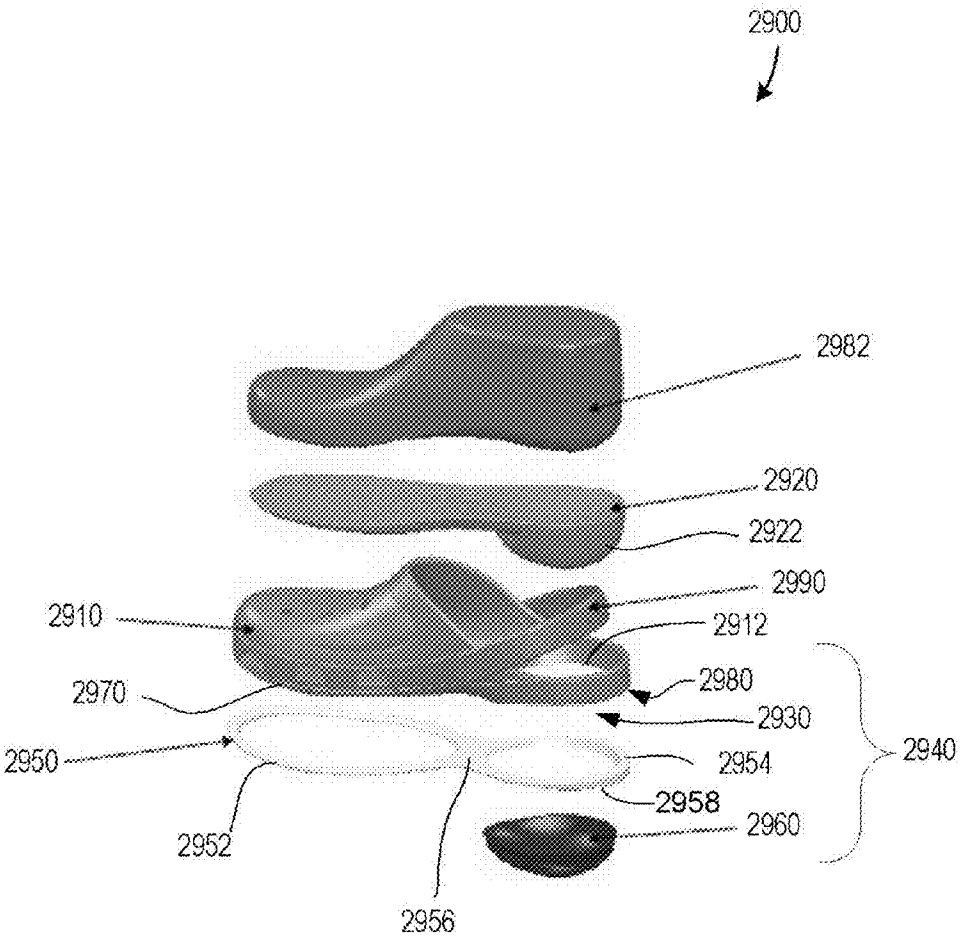
FIG. 30 is an exploded isometric view of a last and toning clog, according to embodiments of the present invention.
Figure 31:
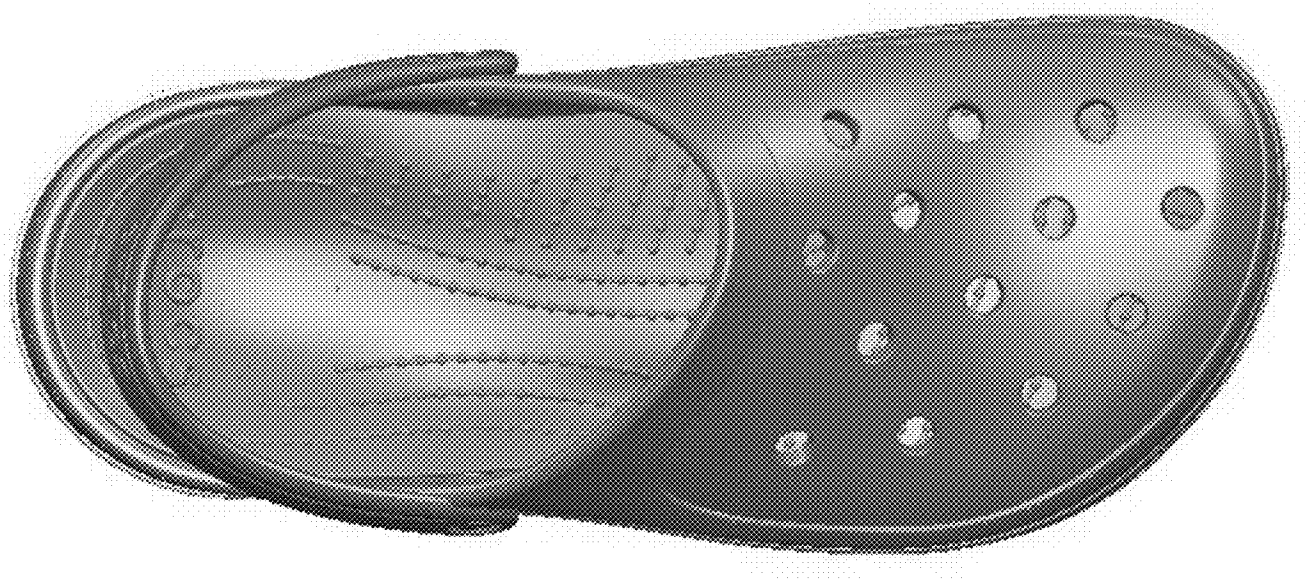
FIG. 31 is a top view of the toning clog of FIG. 22.
Figure 32:
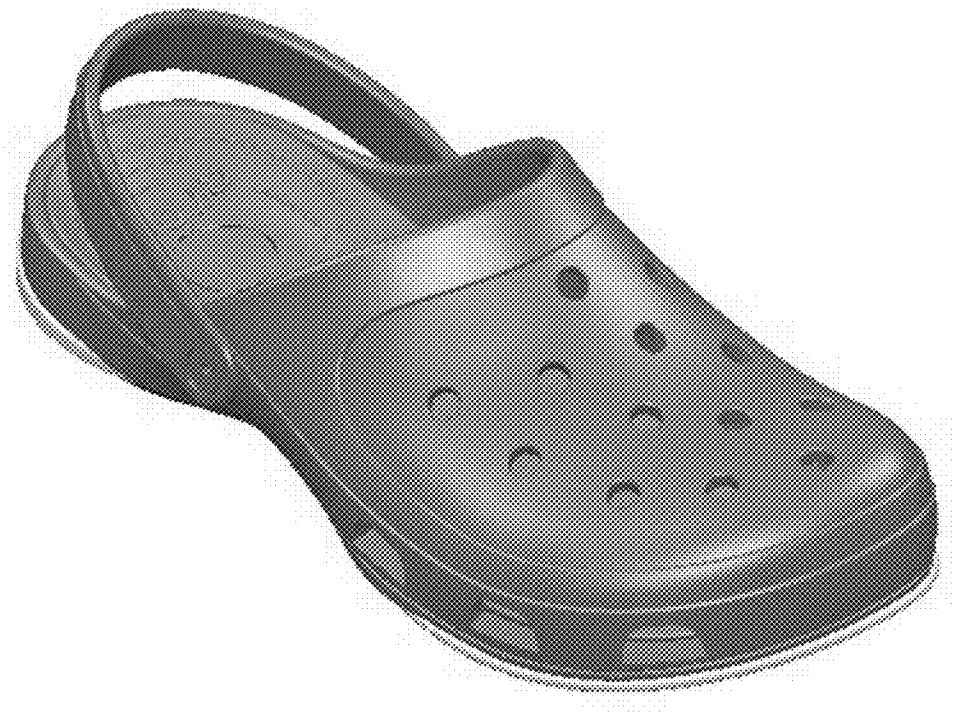
FIG. 32 is a front perspective view of the toning clog of FIG. 22.
Figure 33:
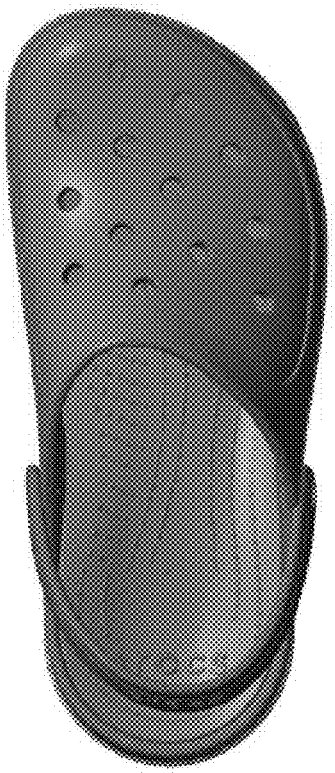
FIG. 33 illustrates a top view of the clog of FIG. 32, according to embodiments of the present invention.
Figure 34:
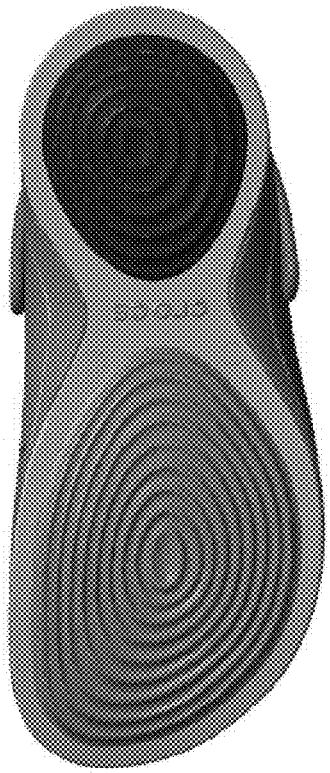
FIG. 34 illustrates a bottom view of the clog of FIG. 32, according to embodiments of the present invention.
Figure 35:
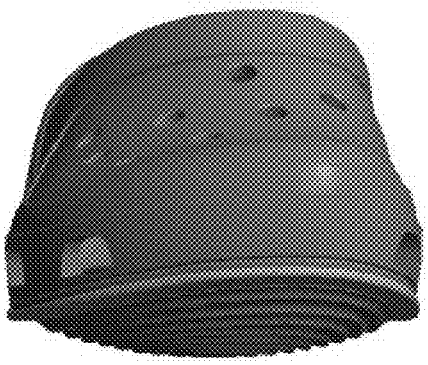
FIG. 35 illustrates a front view of the clog of FIG. 32, according to embodiments of the present invention.
Figure 36:
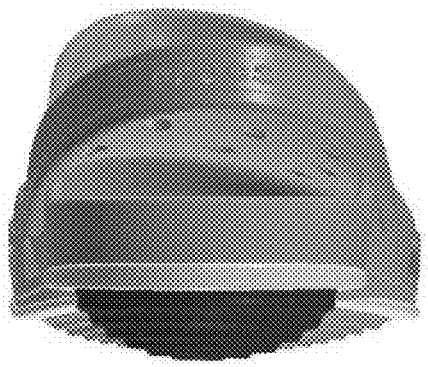
FIG. 36 illustrates a back view of the clog of FIG. 32, according to embodiments of the present invention.
Figure 37:
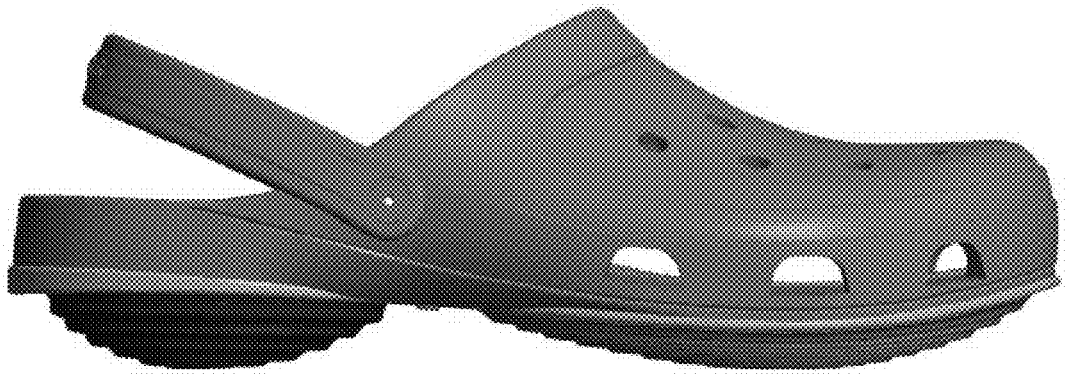
FIG. 37 illustrates an outer side view of the clog of FIG. 32, according to embodiments of the present invention.
Figure 38:
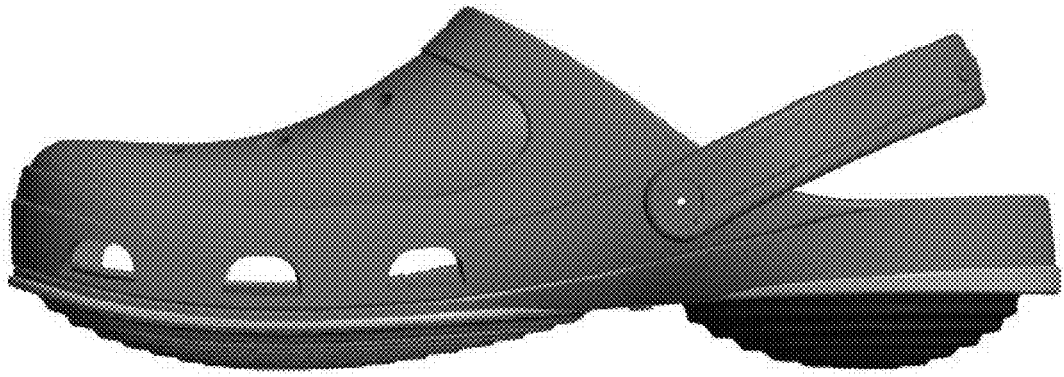
FIG. 38 illustrates an inner side view of the clog of FIG. 32, according to embodiments of the present invention.

FIG. 29 is an isometric exploded view of a toning clog 2900, according to several embodiments of the invention. The support band 2950 includes rings 2952 and 2954 which meet a support section 2956. A heel portion 2970 is placed into ring 2954, and can be fastened to the ring through adhesive, by a snap fit, or through other coupling mechanisms. In other embodiments the heel portion 2970 is fastened on a bottom surface 2958 of ring 2954. The heel portion 2970 may be formed of Croslite® resin or similar materials, and may form a hollow shell. In some embodiments, the heel portion 2970 may be formed of rubber or similar materials that add durability to the shoe. An upper portion 2910 comprises a forefoot portion 2960, which is configured to fit inside the ring 2952. Like the heel portion 2970 and ring 2954, the forefoot portion 2960 and ring 2954 may be secured together using various attachment mechanisms. The insole 2920 is placed within the upper portion 2910, and may be formed of Croslite® resin or other material suitable for contact with a user's foot. In several embodiments, the insole 2920 is formed of a material that is softer than the material forming the upper portion 2910. In certain embodiments, the upper portion 2910 has an aperture 2912 with a perimeter substantially matching or corresponding to the perimeter of the heel portion 2970, as seen in FIG. 30. In those embodiments, the insole 2920 includes a lower protrusion 2922 configured to nest inside the hollow heel portion 2970. The protrusion 2922 may be integrally formed with the insole or may be separately formed and attached to the insole. The heel portion 2970 may be attached to the protrusion 2922 alone or may be fastened to both the protrusion 2922 and the ring 2950.

FIG. 30 is an isometric exploded view of a last 2982 and toning clog 2900 according to several embodiments. The toning clog 2900 includes a footbed or insole 2920, a support ring 2950, a sole 2940, and an outsole 2930. The sole 2940 may have a support ring groove 2980 configured to secure and/or receive support ring 2950. The insole 2920 may be formed of a soft material for user comfort; in several embodiments the insole may be formed of an EVA-based material that is softer than the upper portion 2910. In those embodiments, the heel portion 2960 is formed of rubber or other durable materials. The heel portion 2960 may be directly attached to the insole 2920, for example to the protrusion 2922, and may also be attached to the support ring 2950. In those embodiments, the shoe utilizes the comfort of a soft insole with the durability and support of a rubber heel. This arrangement also permits the material of the insole 2920 to be softer than normally possible for a surface which contacts the ground at the heel area; this enhanced softness permits higher deformation and/or greater instability of the insole 2920, which may enhance the toning performance of the shoe.

According to embodiments of the present invention, the support band 2950 is inserted over the outsole 2930 from the bottom of the shoe 2900. The support band 2950 is then snapped or snap fitted into place over the outsole 2930 along support ring groove 2980. According to some embodiments, the support ring groove 2980 is not present, and the support band 2950 is simply snapped into placed over the outsole 2930 or adhered to the outsole 2930 at the appropriate location.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A shoe for toning, the shoe comprising:

an outsole formed of a first material, the outsole having an outer perimeter and comprising a forefoot portion, a heel portion, and a midfoot portion located between the forefoot portion and heel portion, wherein when the outsole is set upon a flat ground surface, the outsole contacts the flat ground surface at a forefoot contact area of the forefoot portion and at a heel contact area of the heel portion;

wherein the forefoot portion, other than the forefoot contact area, defines a second forefoot area, the second forefoot area being separated from the flat ground surface by a first distance that is perpendicular to the flat ground surface, and wherein a magnitude of the first distance increases from the forefoot contact area toward the outer perimeter along both directions of a first line in a first transverse plane intersecting the forefoot contact area;

wherein the heel portion, other than the heel contact area, defines a second heel area, the second heel area being separated from the flat ground surface by a second distance that is perpendicular to the flat ground surface, and wherein a magnitude of the second distance increases from the heel contact area toward the outer perimeter along both directions of a second line in a second transverse plane intersecting the heel contact area;

wherein the outsole, other than the forefoot contact area and heel contact area, defines a second outsole area, the second outsole area being separated from the flat ground surface by a third distance that is perpendicular to the flat ground surface, and wherein a magnitude of the third distance, along a third line in a longitudinal plane that intersects the forefoot contact area and the heel contact area and is orthogonal to both the first and second transverse planes, decreases from a front end of the outer perimeter toward the forefoot contact area, increases from the forefoot contact area toward the midfoot portion, decreases from the midfoot portion toward the heel contact area, and increases from the heel contact area toward a back end of the outer perimeter; and a support band coupled to the outsole, the support band formed of a second material different from and stiffer than the first material, the support band at least partially surrounding one or more of the heel portion, the forefoot portion, and the midfoot portion, and the support band being positioned further from the flat ground surface than any portion of the second forefoot area, the second heel area, and the second outsole area.

2. The shoe of claim 1, wherein the first material comprises ethylene-vinyl acetate and the second material comprises thermoplastic polyurethane.

3. The shoe of claim 1, wherein the first material consists of ethylene-vinyl acetate and the second material consists of thermoplastic polyurethane.

4. The shoe of claim 1, wherein the forefoot portion, the heel portion, and the midfoot portion are formed integrally of a resin molded foam material.

5. The shoe of claim 1, wherein the support band is a continuous and closed band surrounding the outsole along the outer perimeter.

6. The shoe of claim 1, wherein the support band extends continuously along an entirety of the outer perimeter.

7. The shoe of claim 1, wherein the support band is wider in a first location adjacent to the midfoot portion than in a second location adjacent to the front end of the outer perimeter and is wider in the first location than in a third location adjacent to the back end of the outer perimeter.

8. The shoe of claim 1, wherein the forefoot portion and the heel portion include contour ridges, and wherein the first, second, and third distances separate the contour ridges from the ground surface.

9. The shoe of claim 1, wherein support band includes a contour ridge.

10. A shoe sole for toning, the shoe sole comprising:

an insole configured to contact a user's foot;

an outsole formed of a first material, the outsole comprising a forefoot toning convexity and a heel toning convexity, wherein when the outsole is set upon a flat ground surface, the outsole contacts the flat ground surface at the forefoot toning convexity and the heel toning convexity; and a stiffener band coupled between the insole on one side and the forefoot and heel toning convexities on another side, the stiffener band formed of a second material different from and stiffer than the first material, the stiffener band at least partially surrounding one or both of the forefoot toning convexity and the heel toning convexity, and the stiffener band being positioned further from the flat ground surface than any portion of the forefoot toning convexity and the heel toning convexity.

11. The shoe of claim 10, wherein the support band comprises a first ring and a second ring, the first ring configured to at least partially surround the heel portion and the second ring configured to at least partially surround the forefoot portion.

12. The shoe of claim 10, wherein the support band comprises a first ring and a second ring, and wherein the first ring is configured to fully surround the heel portion and the second ring is configured to fully surround the forefoot portion.

13. The shoe of claim 10, wherein the stiffener band comprises a first ring and a second ring, and wherein the first ring is configured to at least partially surround the heel toning convexity.

14. The shoe of claim 10, wherein the stiffener band comprises a first ring configured to fully surround the heel toning convexity.

15. The shoe of claim 10, wherein the heel toning convexity is hollow and the insole comprises a protrusion configured to nest inside the hollow heel toning convexity.

16. The shoe of claim 10, wherein the insole and the outsole are formed of ethylene-vinyl acetate.

17. The shoe of claim 16, wherein the stiffener band is formed of thermoplastic polyurethane.

18. A shoe sole for toning, the shoe sole comprising:

an insole configured to contact a user's foot;

an outsole comprising a forefoot toning convexity formed of a first material and a heel toning convexity, wherein when the outsole is set upon a flat ground surface, the outsole contacts the flat ground surface at the forefoot toning convexity and the heel toning convexity; and a stiffener band coupled between the insole on one side and the forefoot and heel toning convexities on another side, the stiffener band formed of a second material different from and stiffer than the first material, the stiffener band at least partially surrounding one or both of the forefoot toning convexity and the heel toning convexity, and the stiffener band being positioned further from the flat ground surface than any portion of the forefoot toning convexity and the heel toning convexity.

19. The shoe of claim 18, wherein the stiffener band comprises a first ring and a second ring, the first ring configured to at least partially surround the heel toning convexity.

20. The shoe of claim 18, wherein the stiffener band comprises a first ring and a second ring, the first ring configured to fully surround the heel toning convexity and the second ring configured to fully surround the forefoot toning convexity.

21. The shoe of claim 18, further comprising an upper that is integrally formed with the forefoot portion.

22. The shoe of claim 18, wherein the heel toning convexity is hollow and the insoles comprises a protrusion configured to nest inside the hollow heel toning convexity.

23. The shoe of claim 18, wherein the insole and the outsole are formed of ethylene-vinyl acetate.

24. The shoe of claim 23, wherein the stiffener band is formed of thermoplastic polyurethane.

* * * * *